US005623253A

United States Patent [19]

Narumiya et al.

[11] Patent Number: 5,623,253

[45] Date of Patent: Apr. 22, 1997

[54] PROJECTED BEAM-TYPE SMOKE DETECTOR

[75] Inventors: Junichi Narumiya, Fujisawa; Mariko Ishida, Yokohama, both of Japan

[73] Assignee: Hockiki Kabushiki Kaisha, Tokyo, Japan

[21] Appl. No.: 454,831

[22] Filed: May 31, 1995

[30] Foreign Application Priority Data

| | | | |
|---|---|---|---|
| May 31, 1994 | [JP] | Japan | 6-117906 |
| Jul. 1, 1994 | [JP] | Japan | 6-150723 |
| Jul. 4, 1994 | [JP] | Japan | 6-151845 |

[51] Int. Cl.[6] ..... G08B 17/10

[52] U.S. Cl. ..... 340/630; 340/693; 250/573

[58] Field of Search ..... 340/628, 630, 340/691, 693; 250/573, 574; 356/338, 339

[56] References Cited

U.S. PATENT DOCUMENTS

| | | | |
|---|---|---|---|
| 4,131,888 | 12/1978 | Galvin | 340/630 |
| 4,651,013 | 3/1987 | Kajii et al. | 340/630 |
| 4,749,871 | 6/1988 | Galvin et la. | 340/630 |
| 4,827,247 | 5/1989 | Giffone | 340/630 |
| 5,381,131 | 1/1995 | Mochizuki et al. | 340/630 |

*Primary Examiner*—Jeffery Hofsass
*Assistant Examiner*—Daniel J. Wu
*Attorney, Agent, or Firm*—Lackenbach Siegel Marzullo Aronson & Greenspan, PC

[57] ABSTRACT

A projected beam-type smoke detector of the type in which a light emitter having a light emitting element is separately mounted from a light receiver having a light pickup element in order to detect a fire by an attenuation in the level of light which the light receiver receives from the light emitter, attenuation being due to the presence of smoke between the light emitter and the light receiver. The detector, comprising the light receiver, a cover status sensor for sensing the closing or opening state of a cover that is closed or opened to allow adjustments such as optical axis adjustment, sensitivity setting for light input and the like, and a control block for controlling each section of the light receiver. The control block sets the adjustment mode to each section of the light receiver when the control block receives a cover open-state signal indicative of the opening of the cover from the cover status sensor. The adjustment mode is automatically set to each section of the light receiver. The light receiver preferably comprises a sensitivity setting status, whereby the control block releases the adjustment mode.

15 Claims, 15 Drawing Sheets

| LED | A/D CONVERTED DIGITAL VALUE | DETECTED VOLTAGE (V) |
|---|---|---|
| RED LED 38F | 200~255 | 3.92~5.00 |
| RED LED 38E | 181~199 | 3.54~3.90 |
| GREEN LED 38D | 176~180 | 3.45~3.52 |
| GREEN LED 38C | 170~175 | 3.33~3.43 |
| YELLOW LED 38B | 100~169 | 1.96~3.31 |
| YELLOW LED 38A | 0~ 99 | 0.00~1.94 |

PRIOR ART

PRIOR ART

PROJECTED BEAM-TYPE SMOKE DETECTOR

BACKGROUND OF THE INVENTION

1. Field of the Invention

The present invention relates to a projected beam-type smoke detector having a light emitter and a light receiver for smoke detection in separate units, and in particular to a projected beam-type smoke detector which allows any of adjustment modes to be automatically set in each section of the light emitter and the light receiver in the adjustment of optical axis and light input level and outputs an irregularity signal when an irregularity occurred.

2. Description of the Related Art

In a prior art projected beam-type smoke detector, the adjustment of an optical axis is performed by looking into the collimation aperture of a light receiver from behind it to see a light emitter and by looking into the collimation aperture of the light emitter from behind it to see the light receiver. Light input is then adjusted referring to the output of a monitor. Sensitivity setting is performed by setting the range selection switch according to a monitoring range in use.

For example, U.S. Pat. No. 4,651,013 discloses the smoke detector shown in FIG. 19. In this smoke detector, adjustment of optical axis and setting of sensitivity are performed as follows. To adjust the optical axis, an optical axis fixing screw 102 on a light emitter is loosened. The main unit of the emitter is adjusted while looking into a collimation aperture 101 until the center of the aperture 101 is aligned with the center of the collimation aperture 101 of the light receiver 100. The fixing screw 102 is lightly tightened to the degree that the main unit is still movable.

In the same manner, the light receiver 100 is adjusted so that it is aligned with the center of the collimation aperture 101 of the light emitter, and then the fixing screw 102 is lightly tightened.

Monitor output (light input level) is then adjusted. The monitor cover 103 of the light receiver 100 is opened to check that the monitor lamp in a set switch 104 flashes.

Next, a range selection switch 105 is set to a position of "adjustment".

A monitor plug 107 supplied is plugged into a monitor jack 106 to connect a measuring mean, for example, a multimeter 108.

Two output adjusting potentiometers 109 (for coarse adjustment), 110 (for fine adjustment) are turned until the multimeter 108 reads an appropriate monitor output.

Each of the light emitter and the light receiver 100 is moved gradually one at a time to find the positional setting that gives the maximum monitor output, and the optical axis fixing screw 102 on each of the light emitter and the light receiver 100 is tightened there.

When the optical axis adjustment and the optical axis fixing of the light receiver 100 and the light emitter is performed, two output adjusting potentiometers 109, 110 are turned until an appropriate monitor output, again.

Active monitoring state is set by setting the range selection switch 105 to the sensitivity setting corresponding to the monitoring range (the range from the light emitter to the light receiver 100) in use and by operating the setting switch 104.

Adjustment of the optical axis and light input level has thus involved a series of adjustment steps as above.

In the course of adjustment in the conventional projected beam-type smoke detector, a measuring instrument should be connected to the smoke detector main unit that is typically mounted at a high position. The smoke detector is then adjusted while observing the measuring instrument there. Thus, the adjustment is difficult and risky. Furthermore, the adjustment cannot be performed without measuring instrument.

Furthermore, the projected beam-type smoke detector is typically installed onto a wall surface. Accordingly, a need exists for a smoke detector which allows optical axis adjustment and sensitivity setting to be performed from sides or from front.

In light of the need, some smoke detectors are equipped with a lamp indicative of light input level to allow optical axis adjustment and setting to be performed in the state that a front cover took off.

For example, FIGS. 20 and 21 show such a conventional projected beam-type smoke detector. A front cover 120 is first removed. The plug for spare battery for the control panel is connected to a power input connector 121. Next, disposed on one side of the main unit 122 is a mode switch 123 having switch positions for optical axis, light input level and monitor setting. The mode switch 123 is set to a position of "optical axis". The optical axis adjustment is performed by turning adjusting screws 124. When the mode switch 123 is set to a position of "optical axis", around of a lens 128 is flashed by flash of a optical axis indicator means set up inside of the lens 128. Therefore, the optical axis adjustment is to be easily. After the optical axis adjustment, a range setting switch 125 is set according to the monitoring range in use. With the mode switch 123 set to "light input level", a light input level control 126 is turned.

Three light-input level indicator lamps 127 are provided, one indicative of insufficient light input level range, another indicative of optimum light input level range, and the third indicative of excess light input level range. The light input level control 126 is turned until the optimum level lamp flashes. When the insufficient level lamp flashes, the light input level control 126 is turned in the direction of light input level increase. When the excess level lamp flashes, the light input level control 126 is turned in the direction of light input level drop. The light input level control 126 is thus turned for the optimum light input level observing three light input level lamps 127.

In succession to the optical axis and light input level adjustments, the mode switch 123 is set to a position of "monitor", the battery is disconnected, and the front cover 120 is mounted.

Initial setting is performed by pressing the set button 129 from the front of the light emitter for a predetermined time. Light pickup output in the absence of smoke is then stored as its initial value. A fire determination level is computed on the basis of the stored initial value and the setting of the range selection switch that sets sensitivity according to the monitoring range (the range between the light emitter and the light receiver). The monitoring function is thus activated.

In the above conventional projected beam-type smoke detector, a fire signal or an irregularity signal may be generated when an operator inadvertently block the optical path by his hand in the course of optical axis and light input level adjustments. With the adjustment mode selected by switching operation, the fire signal and the irregularity signal are prevented from being sent to the control panel.

Both Japanese Patent Application Laid-Open No. 175999/1994 and Japanese Utility Model Application Laid-open No.

82789/1994 have disclosed such a projected beam-type smoke detector wherein each of the light emitter and the light receiver has on its front an operation block that is adjusted with its front cover removed.

In the adjustment of the conventional projected beam-type smoke detector, with the mode switch set to a position of "optical axis", the optical adjustment is performed. In succession, with the mode switch set to a position of "light input level", light input level adjustment is performed. Then, with the mode switch is set to a position of "monitor". Switching operation is complex, and a poor adjustment efficiency thus results.

To disable the fire signal and the irregularity signal, switching to the adjustment mode is required. If the front of the light receiver is inadvertently covered by hand prior to switching to the adjustment mode, the fire signal or the irregularity signal may be accidentally generated.

To flash the light input level lamps, the mode switch should be set to a position of "light input level". To extinguish the lamps, the mode switch should be set a position of "monitor", when the optical axis adjustment and light input level adjustment are complete. Switching on or Off the lamps needs a plurality of switching steps. Thus, the adjustment of the smoke detector is complex and a poor instrument operability results.

Furthermore, to flash an optical axis lamp, the mode switch should be turned to a position of "optical axis". To extinguish the optical axis lamp, the mode switch should be set to one of the other positions. The adjustment is accordingly complex and its efficiency is poor.

In the course of the adjustment of optical axis and light input level, the cover may be mounted with sensitivity setting unadjusted by the range setting switch, or sensitivity setting may be performed with the cover left unmounted. Then, power may be possibly connected with no corrective action taken, Since there is no function available to alarm the operator in such cases, the incorrect step goes undetected. Namely, with the smoke detector in its monitor state in succession to the adjustment, the operator fails to recognize the fact that the smoke detector remains incapable of monitoring smoke in a normally operational manner.

To store the initial value, the set button should be pressed after the cover is mounted. This may be an additional step that occasionally escapes attention of the operator. Furthermore, in the event of power interruption, the stored value will be lost, and the button pressing must be repeated.

Some projected beam-type smoke detectors are provided with a light emitter and a light receiver that faces the light emitter with both units spaced apart by a predetermined range therebetween. At regular intervals, light is emitted in a pulse and attenuation of the pulsed light by smoke is then detected. In such a smoke detector, monitoring intervals (flashing intervals of pulse light) are set to a constant, 3 seconds, for example. Therefore, time delay takes place before an adjustment of optical axis, for example, is reflected as a change in signal. This presents difficulty in adjustment.

To resolve these problems, the smoke detector disclosed in the already cited U.S. Pat. No. 4,651,013 allows monitoring interval to be shortened by connecting a measuring instrument to the monitor terminal of a light receiver.

Specifically, by providing the monitor terminal that gives at the monitoring interval a monitor signal in response to the output of reception of pulsed light and by providing means for shortening the monitor interval in a monitor state with the measuring means connected to the monitoring terminal, to reduce delay time in the monitor signal output, and to be adjustment easily.

Even if the monitoring interval is switched in this way, however, the measuring instrument should be connected to the monitor terminal. The adjustment is still equally complex and thus a poor operability in adjustment results.

SUMMARY OF THE INVENTION

In view of the above problems, the present invention has been developed.

The object of the present invention is to provide a projected beam-type smoke detector that is easy to adjust and offers an improved adjustment efficiency. According to the present invention, in response to an open-state signal from a cover status sensor means, several adjustment modes are set. A fire signal and an irregularity signal are disabled while monitor display means and optical axis indicator means are flashed. Monitoring interval is switched to a short length to make the smoke detector ready for adjustment. By a closed-state signal the smoke detector reverts to its active monitoring state.

To achieve the above object, the projected beam-type smoke detector, according to the present invention, of the type in which a light emitter having a light emitting element is separately mounted from a light receiver having a light pickup element in order to detect a fire by an attenuation in the level of light which the light receiver receives from the light emitter, said attenuation being due to the presence of smoke between the light emitter and the light receiver, comprising:

in the light receiver, cover status sensor means for sensing the closing or opening state of a cover that is closed or opened to allow adjustments such as optical axis adjustment, sensitivity setting for light input and the like, and a control block for controlling each section of the light receiver, whereby the control block sets the adjustment mode to each section of the light receiver when the control block receives a cover open-state signal indicative of the opening of the cover from cover status sensor means.

In the present invention thus constructed, each section of the light receiver is automatically shifted to the adjustment mode by simply opening the cover.

The above arrangement eliminates the need for setting the adjustment mode to each of the light receiver on an individual basis, and offers a substantially improved adjustment efficiency.

In the present invention, the light receiver preferably comprises an adjustment mode command switch for commanding setting an adjustment mode to each section of the light receiver when the adjustment is performed, whereby the control block sets the adjustment mode for a predetermined time T2 when the control block receives a cover open-state signal indicative of the opening of the cover from cover status sensor means and when the control block receives from the adjustment mode command switch an adjustment mode enabling signal indicative of the adjustment mode being commanded.

In the above arrangement of the present invention, the adjustment mode for a predetermined time T2 is automatically commanded by setting the adjustment mode command to adjustment mode state under the state that cover opened.

Therefore, the adjustment can be done during the long time T2.

In the present invention, the light receiver preferably comprises a sensitivity setting switch for setting sensitivity, said sensitivity setting switch constituting said adjustment mode command switch, whereby the sensitivity setting switch in its no sensitivity setting state is in the state that the adjustment mode is commanded from the adjustment mode command switch.

Therefore, the opening of the cover automatically activates the adjustment mode.

The above arrangement eliminates the need for comprising independent the adjustment mode command switch to each of the light receiver, and offers a substantially improved adjustment efficiency.

In the present invention, the light receiver preferably comprises sensitivity setting status sensing means for determining the setting status of the sensitivity setting switch, Whereby the control block releases the adjustment mode from each section of the light receiver sets the fire monitoring mode when the control block receives a cover closed-state signal indicative of the closing of the cover from cover status sensor means and when the control block receives from the sensitivity setting status sensing means an sensitivity setting signal indicative of the setting of the sensitivity by the sensitivity setting switch.

Therefore, the adjustment mode is automatically released by setting the sensitivity setting switch to sensitivity setting state and closing the cover.

The above arrangement eliminates the need for releasing the adjustment mode manually when the adjustment is performed, and offers a substantially improved adjustment efficiency. An omission of an adjustment step is avoided, and offers reliability of the fire detectoring.

In the present invention, the control block preferably sets the adjustment mode for a predetermined time T1 when the control block receives a cover open-state signal indicative of the opening of the cover from cover statue sensor means and when the control block receives from the sensitivity setting status sensing means an sensitivity setting signal indicative of the setting of the sensitivity by the sensitivity setting switch.

In the above arrangement of the present invention, the adjustment mode for a predetermined time T1 is automatically commanded by setting the adjustment mode command to adjustment mode state under the state that cover opened.

Therefore, the adjustment can be done during the short time T1.

In the present invention, the light receiver preferably comprises signal output disabling means for disabling, under the adjustment mode, a fire signal that is provided when a fire is detected and an irregularity signal that is provided when irregularity occurred such as light emitted by the light emitter is blocked by any obstacle other than smoke and the like.

Therefore, the fire signal and the irregularity signal output is automatically disabling under the adjustment mode. An omission of an adjustment step is avoided, and offers a substantially improved adjustment efficiency.

In the present invention, the light receiver preferably comprises monitor display means that displays light input level to adjust input level of pulse light from the light emitter under the adjustment mode.

Therefore, the opening of the cover automatically activates the adjustment mode and the monitor display means.

During adjustment, the monitor display means needs not be manually activated, and an improved adjustment efficiency results.

In the present invention, the monitor display means is preferably made up of an LED that light or flashes when light input level is in appropriate range, another LED that light or flashes when light input level is in excessive range, and a third LED that light or flashes when light input level is in insufficient range, whereby the LED that light or flashes when light input level is in appropriate range is different from other LEDs in color and provided double.

Therefore, light input level lamps indicate excess, appropriate or insufficient light input level by their color, and a technician is able to recognize light input level at a glance. The adjustment efficiency will be improved even more. And the center of appropriate range is able to recognize easily by said double LEDs indicate that light input level is appropriate.

In the present invention, said two LEDs that light or flashes when light input level is in appropriate range preferably have ranges narrower than those for the other LEDs.

Therefore, in the adjustment of light input level, the appropriate ranges are narrowed, and setting to the appropriate light input level is easy to make.

In the present invention, the light receiver preferably comprises optical axis indicator means that flashes to help easily in optical axis adjustment.

Therefore, the opening of the cover automatically activates the adjustment mode and the optical axis indicator means.

During adjustment, the optical axis indicator means needs not be manually activated, and an improved adjustment efficiency results. And flashing the LED as the optical axis indicator means improved the optical axis adjustment.

In the present invention, the light receiver preferably comprises light emission control means that gives to the light emitter a light emission control signal that controls the flashing interval of pulse light in light emitter, and monitoring interval changing means which gives to light emission control means a signal for changing the flashing interval to a shorter length than length of flashing interval for normal monitoring under the adjustment mode and which gives to the light emission control means a signal for changing the flashing interval to normal length when the adjustment mode is released.

Therefore, the opening of the cover automatically activates the adjustment mode and the monitoring interval changing means.

During adjustment, the monitoring interval changing means needs not be manually activated. And the flashing interval of pulse light in light emitter is changed to short length, the result of the optical adjustment is thus output as change of light input level without time delay, the adjustment efficiency is even more improved.

In the present invention, the light receiver preferably comprises irregularity signal output means that gives the irregularity signal in response to the signals from cover status sensor means and sensitivity setting status sensing means, when a closing of the cover with no sensitivity setting completed is detected, when a continuous opening of the cover for T1 or longer time with sensitivity setting completed is detected, or when an opening of the cover for T2 or longer time with no sensitivity setting completed is detected.

According to the present invention, when the cover is closed with no sensitivity setting completed, when the closing of the cover is presumed forgotten with sensitivity setting completed, or when the closing of the cover and the sensitivity setting is presumed forgotten with optical adjustment completed, the irregularity signal is output causing the irregularity lamp to flash. Thus, an operator is alerted to any of the above errors and to the fact that the smoke detector is not in the normal monitoring condition.

In the present invention, the light receiver preferably comprises initial value setting means which sets a light input level as an initial value that is used as a reference for computing a fire determination level that determines that a fire is breaking out when the closing of the cover with sensitivity setting completed is detected in response to the signals from cover status sensor means and sensitivity setting status sensing means, fire determination level computing means for computing the fire determination level based on the initial value stored by the initial value setting means and the sensitivity set by the sensitivity setting switch, and fire monitoring means for fire monitoring with respect to the fire determination level already computed when the initial value is already set.

According to the present invention, when the sensitivity setting status sensing means determines that sensitivity setting is performed and when the cover status sensor means determines that the cover is closed, light input level is automatically set as the initial value when no initial value has been set. Based on the initial value set and the sensitivity set, the fire determination level is computed to be used for fire monitoring. Unlike the prior art, the present invention is free from an inconvenience involving pressing a set button after closing a cover. Such a step often escapes attention of a technician. In the conventional smoke detector, the set button should be pressed when power is recovered in the event of a power interruption that caused a stored initial value to be lost. Such an inconvenience is also eliminated in the smoke detector according to the present invention. Without pressing the set button, the fire determination level is automatically computed and the fire detectoring activated. Therefore, time of without fire detectoring is reduced.

In the present invention, the initial value setting means preferably stores a plurality of light inputs of pulse light from the light emitter, averages them, and uses the averaged value as the initial value.

Therefore, the plurality of light inputs of the pulse light from the light emitter is automatically stored and averaged, and the averaged value is used as the initial value.

In contrast to the case where a single light input at closing the cover is used, the initial value is steadier and more reliable. This excludes the possibility that a light input received in an abnormal condition is used as the initial value. A more reliable fire monitoring operation thus results.

In the present invention, the initial value setting means preferably output a irregularity signal when said initial value falls outside the predetermined range.

According to the present invention, the irregularity signal is output when said initial value falls outside the predetermined range.

Therefore, the storing an abnormal value as the initial value is prevented, a more reliable fire monitoring operation thus results.

BRIEF DESCRIPTION OF THE DRAWINGS

FIG. 4(*b*) shows the setting state of DIL switch for setting sensitivity.

DETAILED DESCRIPTION OF THE PREFERRED EMBODIMENTS

Figure 1:
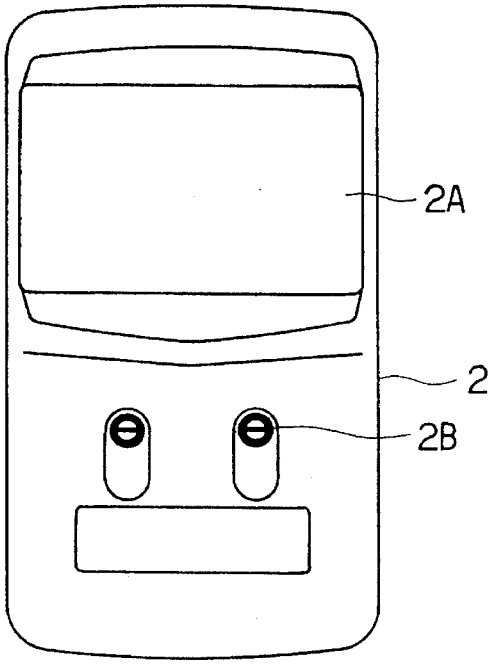
FIG. 1 is a front view showing the light receiver of the projected beam-type smoke detector of an embodiment of the present invention.
Figure 2:
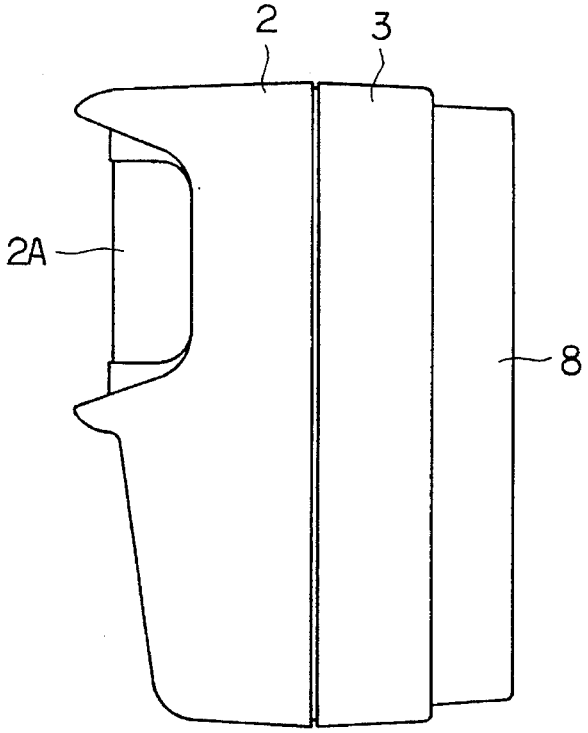
FIG. 2 is a side view of the projected beam-type smoke detector of FIG. 1.

Referring now to the drawings, the present invention are now discussed.

FIGS. 1 through 18 show one embodiment of the present invention.

Figure 3:
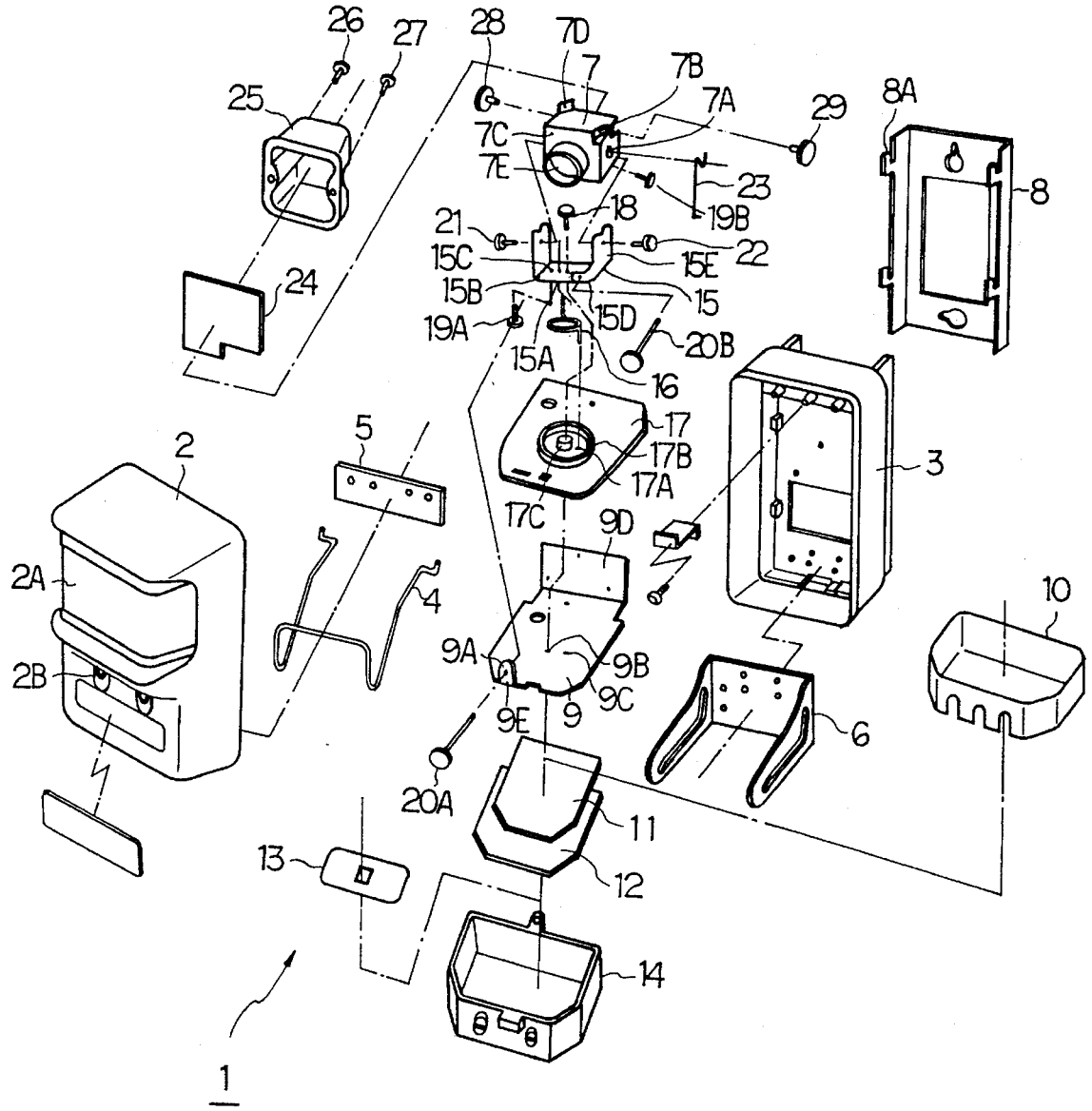
FIG. 3 is a perspective exploded view showing the light receiver.

FIG. 3 is the perspective exploded view showing a light receiver 1. A light emitter 42 that is paired with the light receiver 1 is identical to the light receiver 1 except a light emission element and its associated circuit and components. Since most of description of the light receiver 1 is applicable to the light emitter 42 as well, the difference therebetween will be discussed in the description of the light emitter 42.

In FIG. 3, the light receiver 1 of the projected beam-type smoke detector is spaced apart from a light emitter 42 and is mounted on a wall near the ceiling or the ceiling. The light receiver 1 faces the emitter 42 on opposing wall possibly across the room. The light receiver 1 is constructed of a vertically long cover 2 of a front side and main unit 3. The cover 2 is provided with a window 2A formed of a material that transmits near-infrared light with visible light cut off, for example, formed of polycarbonate. The cover 2 is detachably mounted onto the main unit 3 with a cover clamping wire 4, a clamping block 5, and a cover support bracket 6. Attachment or detachment of the cover 2 is performed by sliding the cover 2 vertically. Disposed in the main unit 3 is an optical axis and light input level adjusting mechanism for a lens holder 7 as shown in the exploded view. A mounting bracket 8 is fixed onto the wall near the ceiling by screws. The main unit 3 is engaged with clamping lugs 8A of the mounting bracket 8.

The interior mechanisms housed in the main unit 3 are now discussed in detail. The base 9 of the optical axis and light input level adjusting mechanism is of a metal fixture of L-shape in cross-section, and fixed onto the main unit 3 with its vertical portion attached onto the inner wall of the main unit 3. Disposed within a transparent circuit covering 14 below the base 9 are a shielded case 10, a printed circuit board 11 on which the circuit components for light pickup and the like are mounted, a power supply board 12 and an insulating sheet 13 for the light pickup board.

The base 9 is provided with a mounting hole 9A, an axis hole 9B and an anchoring hole 9C. The mounting hole 9A receives along the optical axis an adjusting screw 20A for adjusting the lens holder 7 horizontally. The axis hole 9B supports the lens holder 7 and its support member 15 in a manner that both are pivoted about the axis hole 9B in a horizontal plane. The anchoring hole 9C anchors one end of a coil spring 16 for restricting the horizontal displacement of the lens holder 7.

A separator 17 is attached onto the base 9 at the axis hole 9B by a fixing screw 18. The separator 17 is received between the flange portions 9D, 9E of the base 9 so that a relatively pivotal movement therebetween in a horizontal plane is restricted. The separator 17 is provided with a through-hole 17A through which the coil spring 16 is inserted, a recess 17B receiving the coil spring 16 and an axis hole 17C.

The lens holder 7 is pivotally supported in a vertical plane by the support member 15 of general U-shape in cross section. The support member 15 is pivotally supported in a horizontal plane about the fixing screw 18 at the axis hole 17C of the separator 17 and the axis hole 9B of the base 9.

A horizontal pivotal driving mechanism is now discussed. The support member 15 has off its axis hole 15A a locking hole 15B for locking a nut 19A in a vertical direction. The nut 19A is threaded so that it is meshed with the horizontal adjusting screw 20A in the direction of the optical axis. When the adjusting screw 20A is rotated, the support member 15 is thus pivoted in a horizontal plane about the fixing screw 18.

The support member 15 is provided with an anchoring hole 15C for anchoring the other end of the coil spring 16 in a vertical direction and a mounting hole 15D through which an adjusting screw 20B for adjusting the lens holder 7 vertically is inserted in the optical axis direction. The lens holder 7 is supported by the support member 15 in a manner that the lens holder 7 is pivoted in a vertical plane at screws 21, 22 of the support member 15. A coil spring 23 is attached on to the lens holder 7 to restrict its vertical displacement. The coil spring 23 is connected in its one end to the anchoring hole 15E of the support member 15 and in its other end to a clamp 7A on the lens holder 7.

The lens holder 7 has off its pivotal axis a nut 19B oriented transversely. Like the nut 19A, the nut 19B is threaded to be meshed with a vertical adjusting screw 20B along the optical axis. When the adjusting screw 20B is rotated, the lens holder 7 is pivoted in a vertical plane ragainst the support member 15. The lens holder 7 has on its top right corner a collimation aperture 7B into which an operator looks at a squint angle from right front. The lens holder 7 has a collimation aperture 7C on its top left corner and a reflecting mirror 7D which allows the field of view through the collimation aperture 7C to be observed through the collimation aperture 7B. Designated 7E is a lens held by the lens holder 7.

Behind the lens holder 7 are mounted a light pickup board 24 and a light pickup shielded case 25 by screws 26 and 27. Disposed on a light pickup board 24 are light input level controls 28, 29. With the adjustment of the light input level controls 28, 29, the light input level adjustment carried out by varying photoelectric conversion voltage in a photoelectric converter circuit. The control 28 is for coarse adjustment, and the control 29 is for fine adjustment.

Figure 4A:
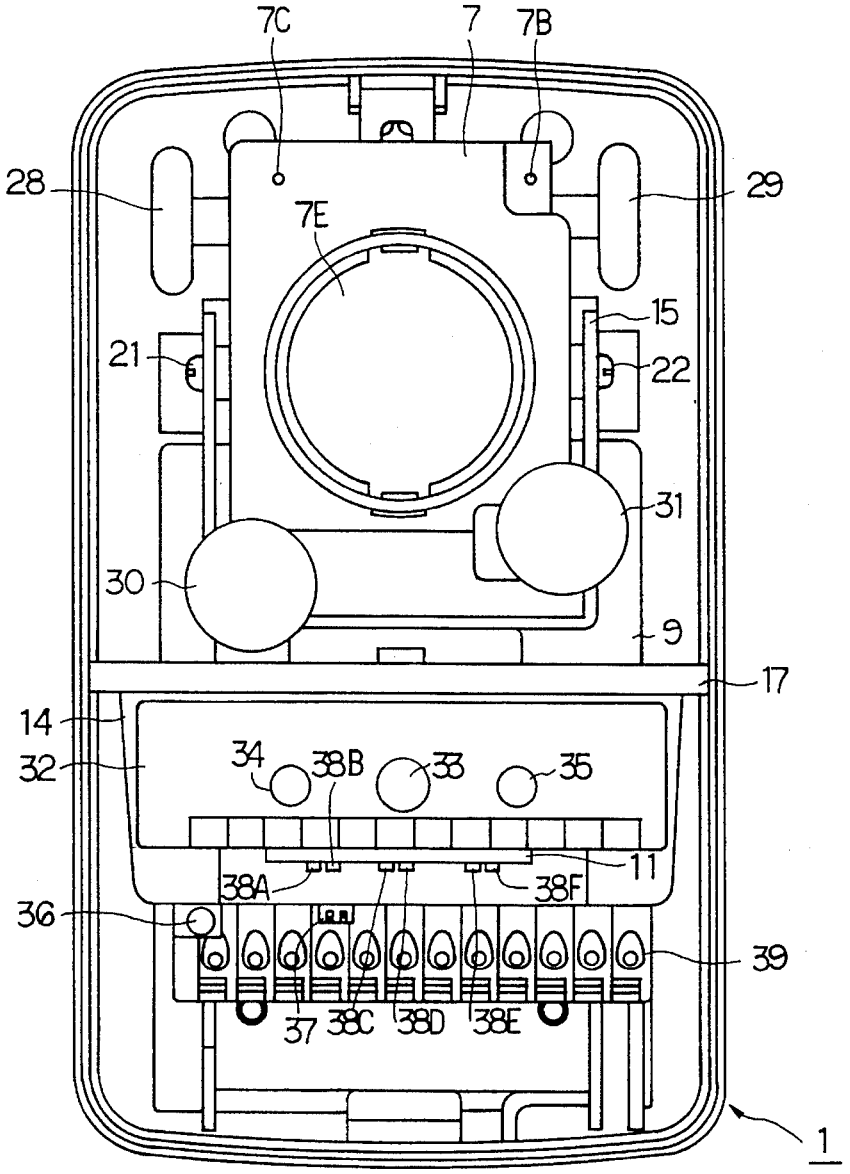
FIG. 4(*a*) is a front view showing the light receiver with its front cover removed.
Figure 4B:
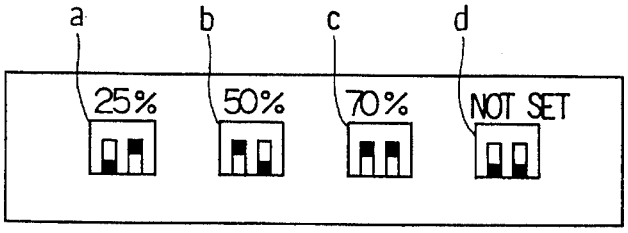

FIG. 4(*a*) is the front view showing the light receiver with its front cover 2 removed.

In FIG. 4(*a*), designated 30 is an optical axis adjusting knob for the adjusting screw 20A. Designated 31 is the optical axis adjusting knob for the adjusting screw 20B. Both optical adjusting knobs 30, 31 are oriented frontward since corresponding adjusting screws 20A, 20B are aligned with the direction of the optical axis. With the cover 2 removed, adjustment is easily performed without the need for groping for a control on the sides or rear of the unit at an elevated position. When the optical axis adjusting knob 30 of the horizontal adjusting screw 20A is rotated counterclockwise, the lens holder 7 is pivoted to the left. Conversely, when the optical axis adjusting knob 30 is clockwise rotated, the lens holder 7 is pivoted to the right. When the optical axis adjusting knob 31 of the vertical adjusting screw 20B is counterclockwise rotated, the lens holder 7 is pivoted downward. Conversely, when the optical axis adjusting knob 31 is clockwise rotated, the lens holder is pivoted upward. Both optical adjustment knobs 30, 31 is suitable size for finger operating, therefore tools such as screwdrivers is not need.

The lens holder 7 houses the lens 7E. As already discussed, the lens holder 7 is pivotally supported by the support member 15 in a vertical plane, and the support member 15, in turn, is pivotally supported by the base 9 in a horizontal plane.

A nameplate 32 is glued onto the front portion of the circuit cover 14 below the separator 17 mounted onto the base 9. The printed circuit board 11 has an optical axis lamp 33 by which the optical axis is checked. The optical axis lamp 33 is a red LED. During optical axis adjustment, the lamp 33 flashes so that it is easily recognized. Disposed to the left of the optical axis lamp 33 on the printed circuit board 11 is a fire alarm lamp 34 indicative of fire. Disposed to the right of the optical axis lamp 33 is an irregularity LED lamp 35 indicative of an irregularity. Light emitted from each of the optical axis lamp 33, the fire alarm lamp 34, the irregularity lamp 35 is directed outward through respective holes disposed in the transparent cover 14 and the nameplate 32.

Since the indicator lamps such as the fire alarm lamp 34 and the irregularity lamp 35 are arranged so that their light is emitted in a horizontal direction at an elevated position, there is a difficulty in recognizing the light from below.

To avoid such a difficulty, it is contemplated that the indicator lamp itself or an optical member for guiding light emitted from the indicator lamp is horizontally projected from the vertical front or side cover of a detector cabinet to deliver light outward. Such an arrangement is not only aesthetically unacceptable but also subject to damage on its indicator lamp or optical member during shipping.

In view of the above problem, the present invention provides the indicator lamp viewing structure of an smoke detector at an elevated position that is easily visibly recognizable from below without using the arrangement in which the indicator lamp delivering light horizontally is projected horizontally from the vertical front or side cover of the detector cabinet.

Figure 5:
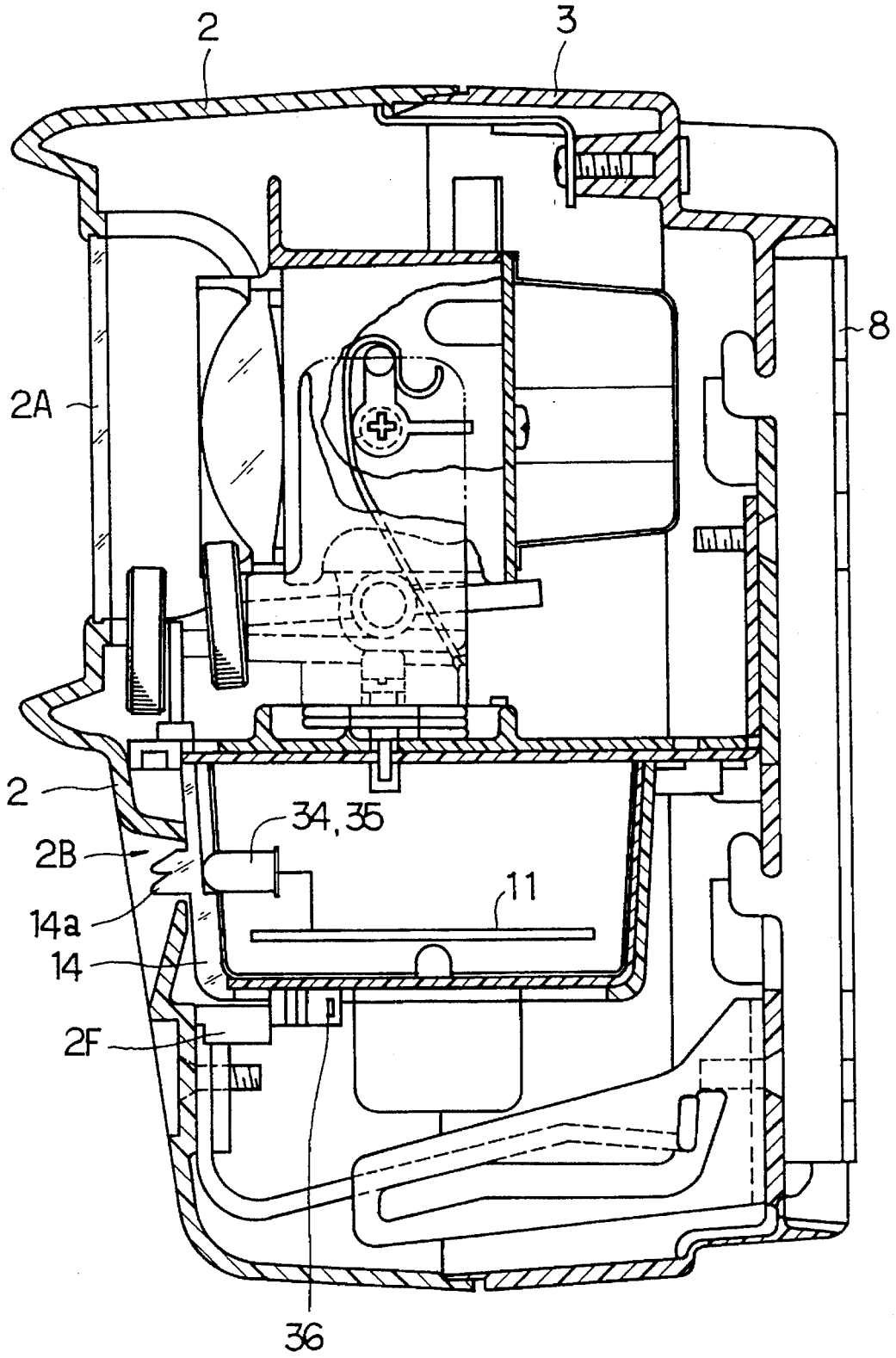
FIG. 5 is a cross-sectional view of FIG. 2.
Figure 7:
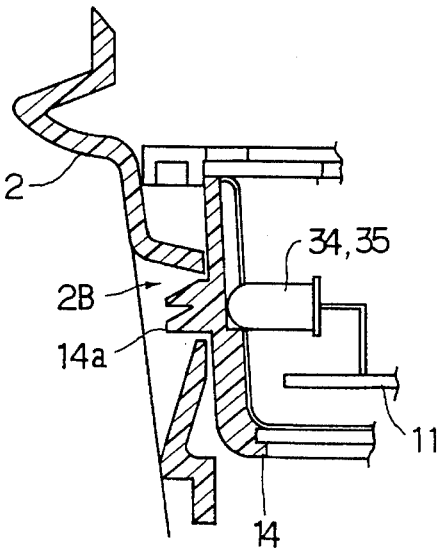
FIG. 7 is an enlarged view showing part of FIG. 5.

Such a indicator lamp viewing structure is now discussed. The fire alarm lamp 34 is mounted on the printed circuit board 11 housed in the transparent circuit cover 14 on the main unit 3 so that the fire alarm lamp 34 emits light frontward as shown in FIGS. 5 and 7. The transparent circuit cover 14 facing the fire alarm lamp 34*a* has integrally a beam splitter 14*a* of wedge-like shape in cross-section. The beam splitter 14*a* transmits part of light from the fire alarm lamp 34 toward a light projector while refracting the remainder of light from the lamp 34 downward at an approximately right angle downward.

Figure 6:
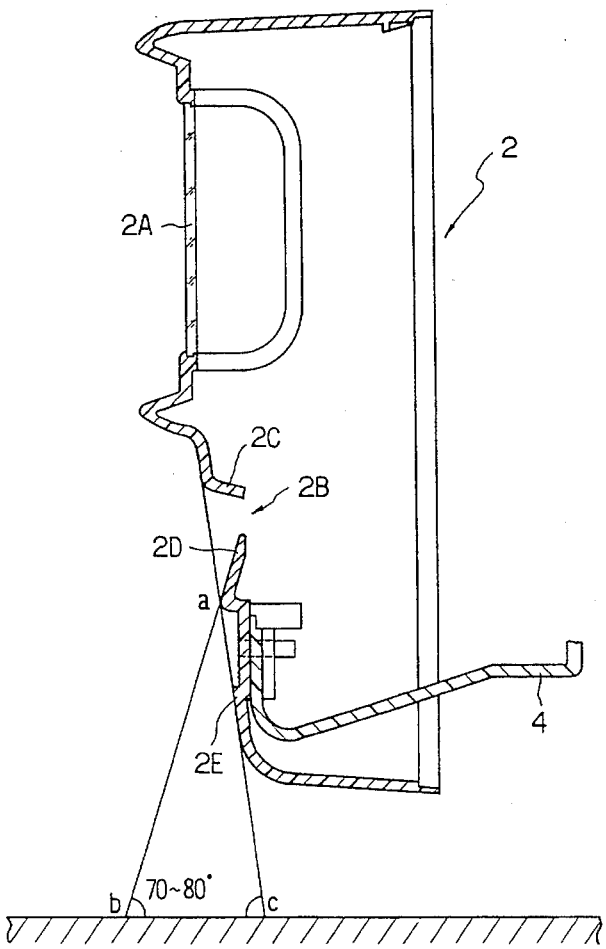
FIG. 6 is a cross-sectional view showing the front cover.

The cover 2 has an aperture 2B at its corresponding position to the beam splitter 14*a* and the fire alarm lamp 34 in a manner that allows the aperture 2B to pass the beam splitter 14*a* horizontally to expose it to the outside. As shown in FIG. 6, an upper periphery 2C and a lower periphery 2D, both defining the aperture 2B, are recessed and inclined inwardly toward their end so that the beam splitter 14*a* exposed to the outside is not projected from the general front surface of the cover 2. The lower front portion 2E of the cover 2 is gradually recessed as it runs downward.

The window 2A of the cover 2 is vertical, and the lower portion of the cover 2 below the lower edge of the window 2A is substantially flush with the lower front portion 2E. An angle abc made by the lower periphery 2D and a horizontal line segment bc and an angle acb made by the lower front portion 2E and the horizontal line segment bc fall within somewhere between 70° and 80°.

Figure 8:
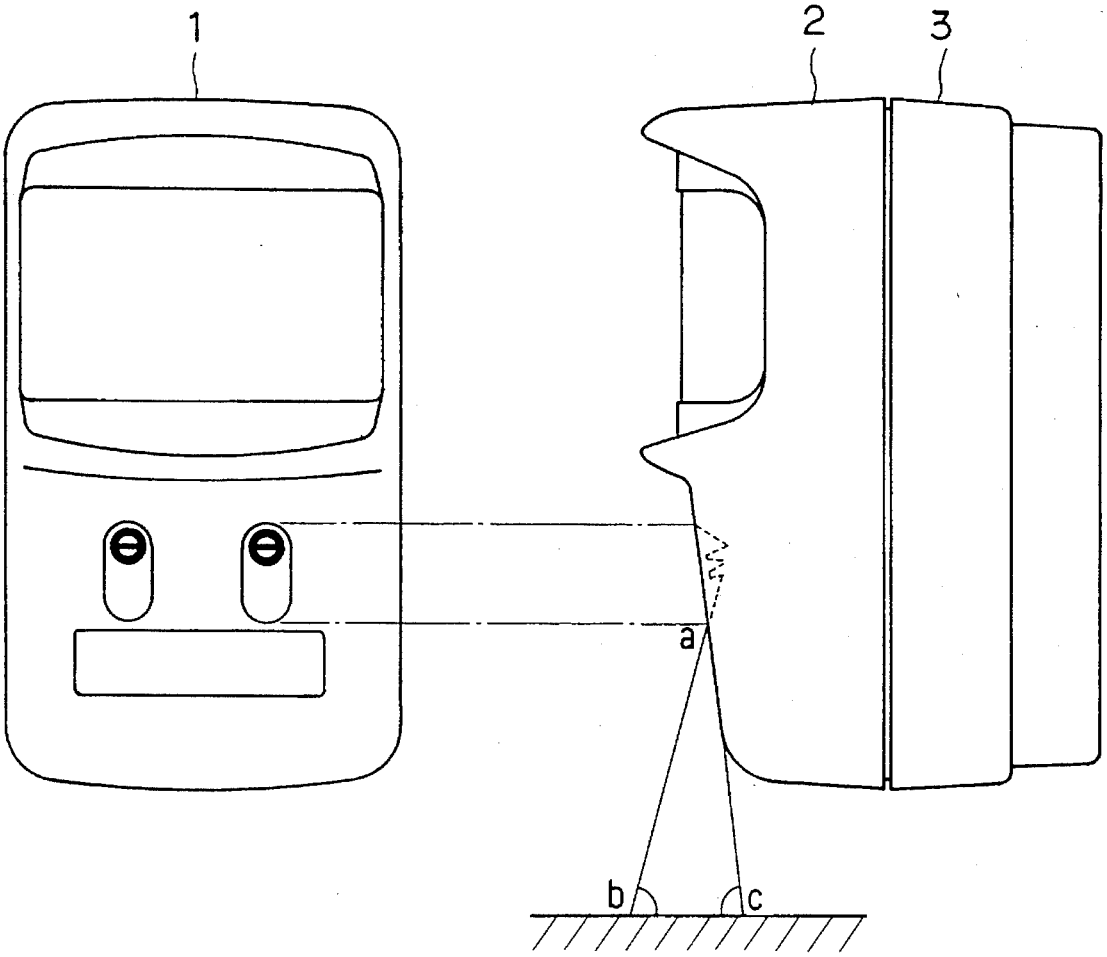
FIG. 8 shows the outline of the light receiver and also is an explanatory view of the light pickup when viewed from below.

FIG. 8 shows a normally installed smoke detector at an elevated position with cover 2 attached onto main unit 3. In such an arrangement, when the fire alarm lamp 34 comes on, the beam splitter 14*a* allows light to be refracted downward. Light provided by the beam splitter 14*a* that is slightly projected is thus viewable from below at a position b or any position further away therefrom on a horizontal plane. If the beam splitter 14*a* is projected from the surface of the portion 2E, the light is viewable from below from a position c, namely viewable from just below the detector.

Figure 9:
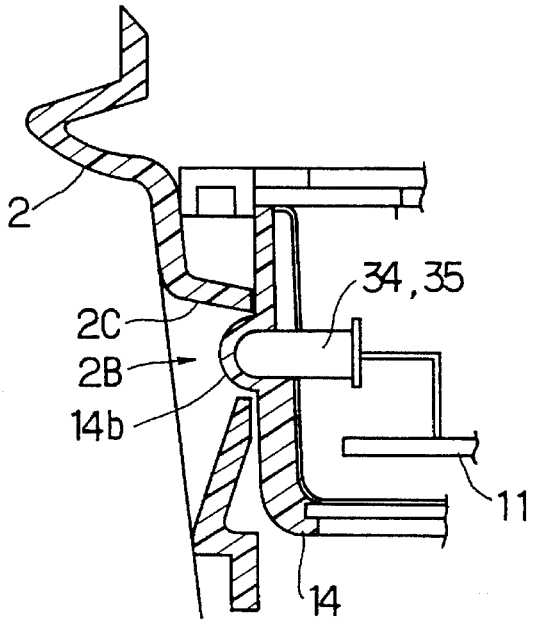
FIGS. 9 and 10 are enlarged views showing other embodiments corresponding to FIG. 7.
Figure 10:
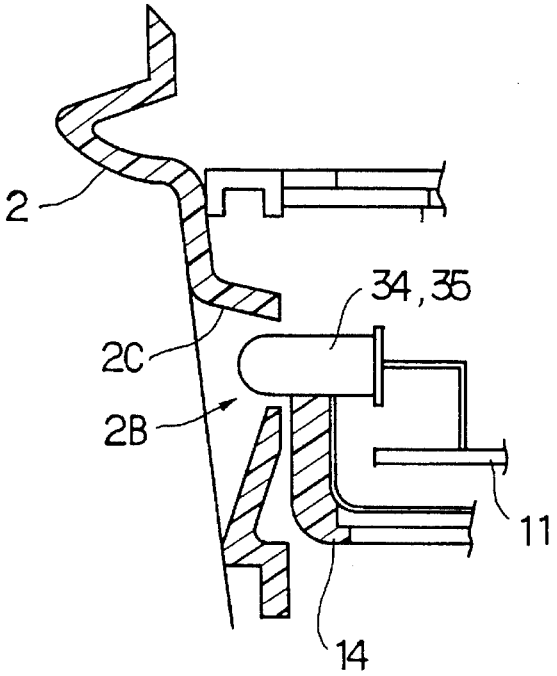

In the above embodiment, the beam splitter 14*a* is an integral part of the transparent circuit cover 14, and light from the fire alarm lamp 34 is refracted downward at an approximately right angle. Alternatively, a portion 14*b* of the circuit cover 14 may be designed to be projected so that the fire alarm lamp 34 is also projected frontward as shown in FIG. 9. The fire alarm lamp 34 itself may be projected frontward as shown in FIG. 10. In this case, non-transparent circuit cover 14 may be acceptable. In FIGS. 9 and 10, the upper periphery 2C and its side portions defining the aperture 2B may be provided with a reflecting plate or aluminum may be deposited on the upper periphery 2C so that the resulting reflecting surface reflects light from the fire alarm lamp 34 downward.

Figure 11A:
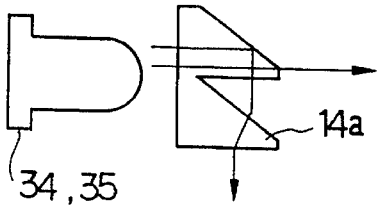
FIGS. 11 and 12 are explanatory views showing other examples of the beam splitter.
Figure 11B:
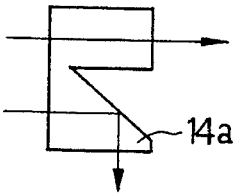
Figure 12:
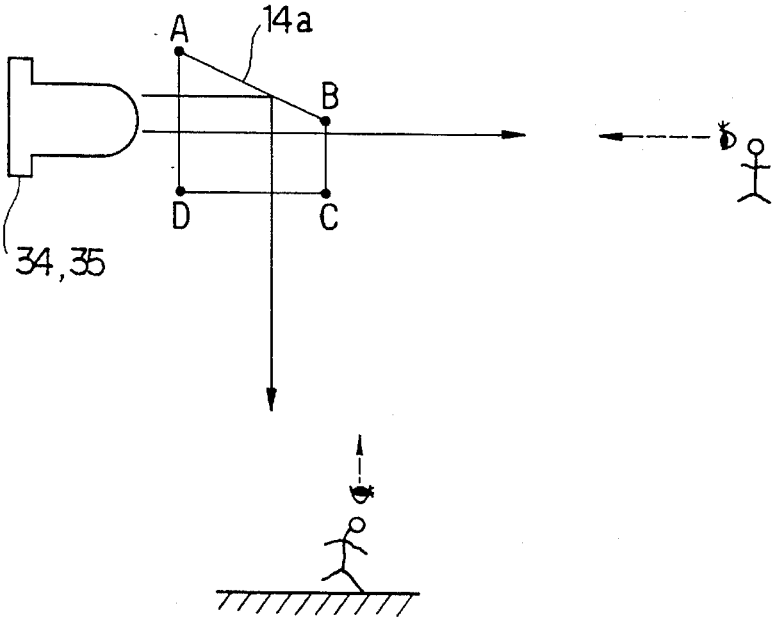

The beam splitter 14*a* is not limited to the one of wedge-like shape in cross-section shown in FIG. 11(*a*). The beam splitter 14*a* may be delineated in its geometry into one portion for transmitting light and the other portion for refracting light as shown in FIG. 11(*b*). Alternatively, the beam splitter 14*a* may be of a trapezoid in cross-section as shown in FIG. 12. The trapezoidal beam splitter 14*a* in FIG. 12 is formed of polycarbonate resin or acrylic resin. A face AD makes a right angle with a face DC, which in turn makes a right angle with a face BC. The fire alarm lamp 34 is positioned on the face AD side of the beam splitter 14*a*. The angle the face AD makes with the face AB agrees with the critical angle of the beam splitter 14*a* relative to its incident angle of light from the fire alarm lamp 34, and light from the fire alarm lamp 34 is refracted downward, namely toward the face DC (according to the Snell laws).

The above viewing structure allows flashlight from the fire alarm lamp 34 to be easily viewed not only from front but also from below.

Although the fire alarm lamp 34 has been discussed, the viewing structure is equally applicable to the irregularity lamp 35. The discussion of the irregularity lamp 35 is thus omitted.

As shown in FIGS. 4(*a*) and 5, provided on the lower portion of the circuit cover 14 is a cover status sensor switch 36 as cover status sensor means for sensing the status of the cover 2. The cover status sensor switch 36 is a limit switch as shown in FIG. 5. Disposed inside the cover 2 at its corresponding position to the cover status sensor switch 36 is a projection 2F that is pressed the cover status sensor switch 36 when the cover 2 is closed.

When the cover 2 is opened, the projection 2F is cleared of the cover status sensor switch 36 causing it to be off. Conversely, when the cover 2 is closed, the projection 2F is pressed asensitivityst the cover status sensor switch 36 causing it to be on.

The cover status sensor mechanism is not limited to the above arrangement of the cover status sensor switch 36 to be pressed by the projection 2F. Alternatively, the cover 2 itself may directly apply pressure to the switch 36.

As FIG. 4(*a*) shows, disposed on the underside of the circuit cover 14 is a range selection switch 37 as a sensitivity setting switch that sets sensitivity according to the monitoring range in use. The range selection switch 37 is constructed of DIL switches, of which setting allows the monitoring range, for example, to be within a range equal to or greater than 5 m and shorter than 45 m, or a range equal to or greater than 45 m and shorter than 100 m. No range setting position is reserved for adjustment mode.

The switch which set directory the sensitivity can be used as the switch that sets sensitivity according to the monitoring range, not restricted said range selection switch 37. If the switch which set directory the sensitivity is used, for example, the setting state of the switch is shows as FIG. 4(*b*). The setting state (a) is to set 25% of the sensitivity, the setting state (b) is to set 50% of the sensitivity, the setting state (c) is to set 70% of the sensitivity.

According to the present invention, an adjustment mode command switch is available to command adjustment mode on each of section of the light receiver during long time.

In this embodiment, the range selection switch 37 functions as the adjustment mode command switch as well.

The range selection switch 37 sets the adjustment mode for a predetermined time T2 at its no range setting position.

The cover status sensor switch 36 and the range selection switch 37 are mounted on the printed circuit board 12.

Figure 13A:
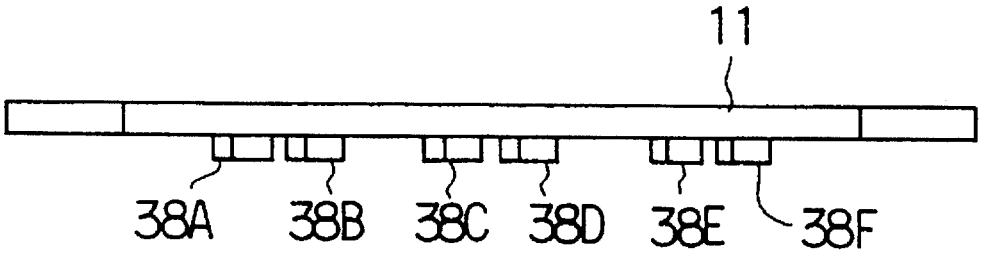
FIG. 13 shows LEDs (light emitting diodes) as monitor display means mounted on a printed circuit board.
Figure 13B:
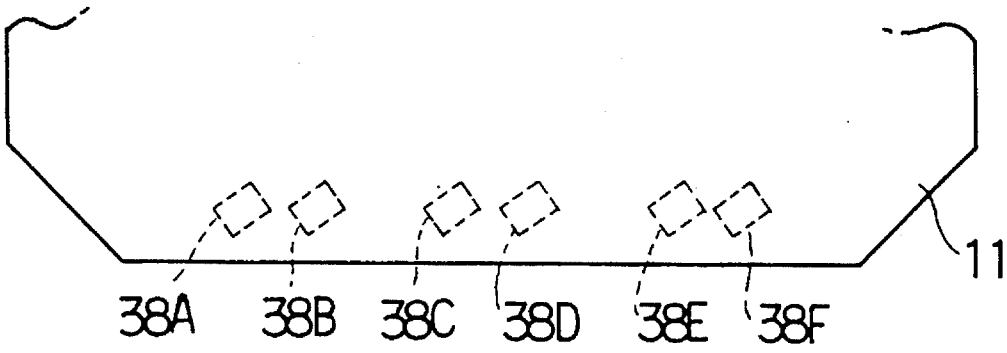

Six chip LEDs 38A–38F as monitor display means are arranged from right to left below the printed circuit board 11. These LEDs 38A through 38F are mounted on the printed circuit board 11 in a manner that they look at a squint angle with respect to the frontward direction as shown in FIGS. 13(A) and 13(B). This arrangement allows the operator to see each of the LEDs 38A through 38F flash from seeing direction through the collimation aperture when he adjusts optical axis.

The LEDs 38A through 38F are arranged from left to right with two yellow LEDs 38A and 38B in pair, two green LEDs 38C and 38D in pair, and two red LEDs 38E and 38F in pair. These LEDs 38A through 38F constitute a light input level meter flashing according to light level.

Specifically, LEDs 38A and 38B flash when light input level is insufficient. LEDs 38C and 38D flash when light input level is appropriate. LEDs 38E and 38F flash when light input level is excessive.

The light input level controls 28, 29 are turned until either of two green LEDs 38C and 38D flashes observing the LEDs 38A through 38F. Light input level is set at its optimum value, and the acceptable range covered by the controls 28, 29 is estimated. And the center of appropriate range is able to recognize easily by the adjustment that said double LEDs 38C and 38D flash by turns. Designated 39 are socket terminals, for connecting signal line and power supply line connecting the control panel 46 and the light emitter 42.

Depending on insufficient, appropriate or excess level, different colored LEDs flash. A technician thus can easily recognize the light input status at a glance.

Figure 14:
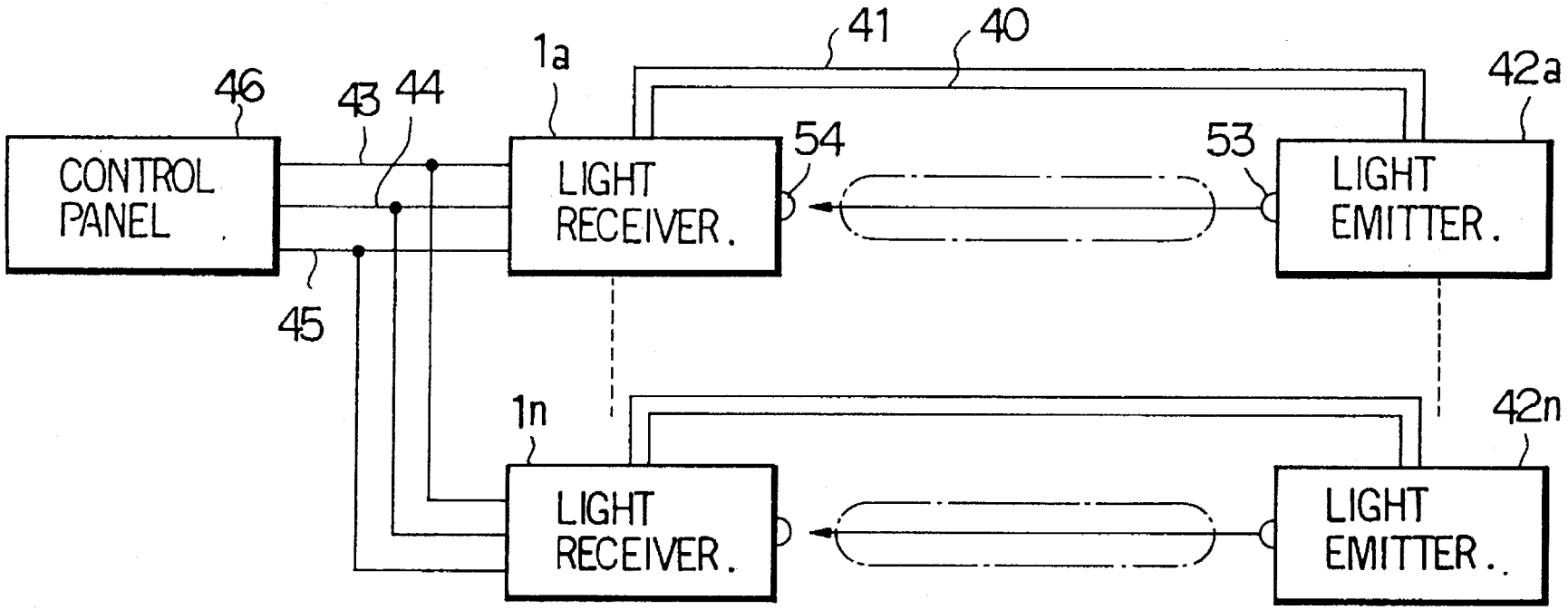
FIG. 14 is a block diagram of the whole fire detector system constituted of the light emitter, the light receiver and the control panel.
Figure 15:
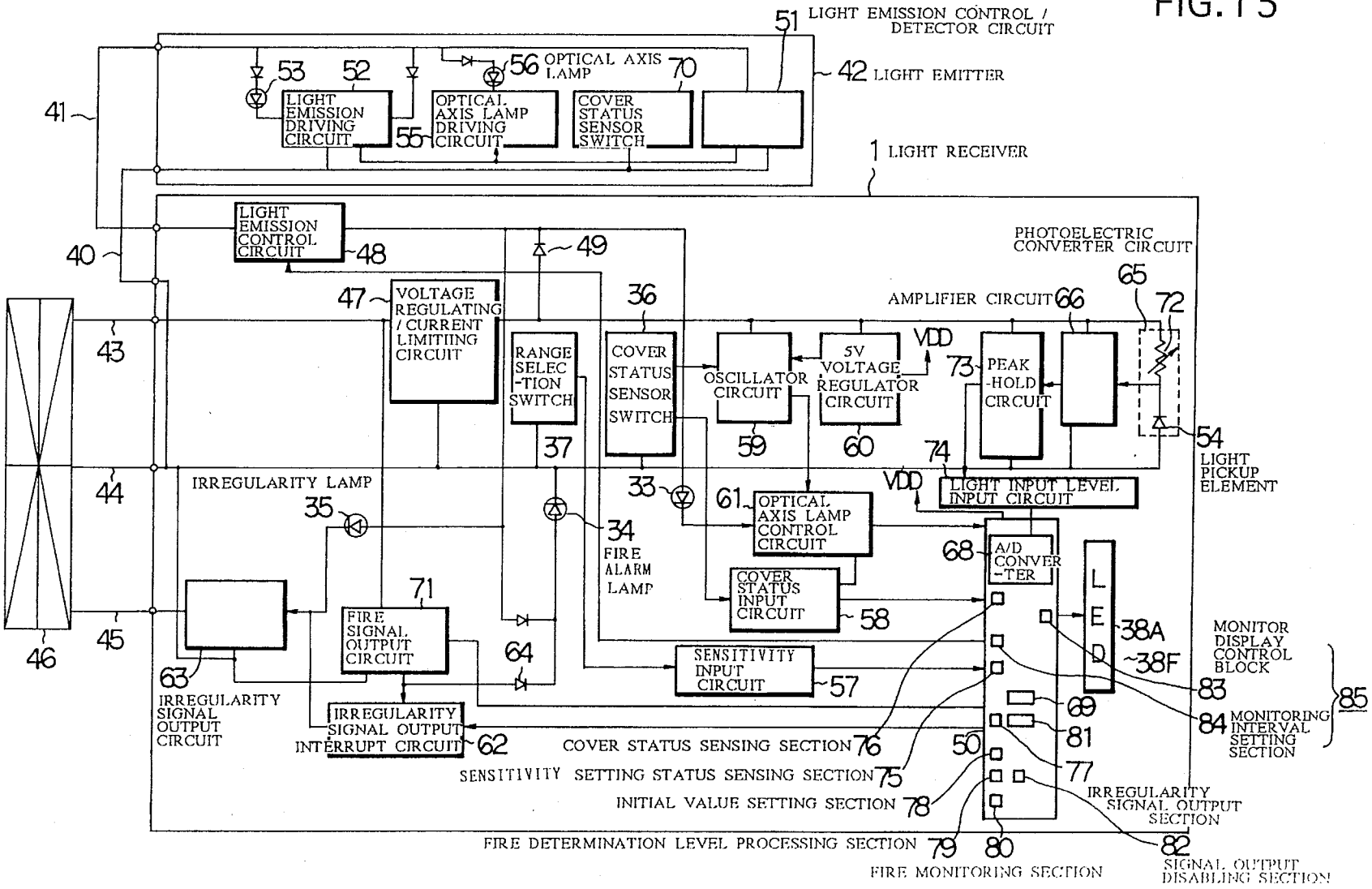
FIG. 15 is a block diagram of the light emitter and light receivers.

FIG. 14 is a block diagram of the whole fire detector system constituted of the light emitter, the light receiver and the control panel, FIG. 15 is the block diagram showing the light emitter 42 and the light receiver 1.

As shown, the light receiver 1*a*~1*n* is connected to the light emitter 42*a*~42*n* via light emitter control lines 40, 41.

The light receiver 1*a*~1*n* is connected to a control panel 46 via a fire signal line 43, a common line 44, and an irregularity signal line 45.

Designated 47 is a voltage-regulating/current-limiting circuit disposed in the light receiver 1. Powered by the receiver 46, the voltage-regulating/current-limiting circuit 47 regulates voltage and supplies the regulated voltage to the associated circuit while performing current limiting function. A light emission control circuit 48 controls the light emission operation of the light emitter 42. The voltage-regulating/current-limiting circuit 47 supplies constant regulated voltage via a diode 49 to the light emission control circuit 48 which in turn feeds the constant regulated voltage to the light emitter 42 via the light emitter control line 41. The light emission control circuit 48 cuts off the regulated voltage to the light emitter 42 for a predetermined duration according to the command from a control block 50. The voltage thus controlled constitutes an emission control signal. Such an emission control signal is sent to the light emitter 42. The light emission control circuit 48 thus supplies the constant regulated voltage with the emission control signal to the light emitter 42.

Designated 51 is a light emission control/detector circuit disposed in the light emitter 42. The light emission control/detector circuit 51 detects the light emission control signal from the light receiver 1 to activate a light emission driving circuit 52. Namely, the light emission control/detector circuit 51 detects power cutoff durations that are the light emission control signal from the light emission control circuit 48, and activates the light emission driving circuit 52 in negative logic. Driven by the light emission driving circuit 52, an LED 53 flashes and emits near-infrared light in pulse toward a light pickup element 54 in the light receiver 1.

The light emission control signal thus controls monitoring intervals at which the light emitter 42 is triggered in pulse. The monitoring intervals are typically set to 3 seconds.

As the intervals of the signal transmitted from the control block 50 are shorter, power cutoff durations that are the light emission control signal from the light emission control circuit 48 become accordingly shorter. Thus, the frequency of monitoring is higher. For example, when the intervals of the signal from the control block 50 are 1 second, the monitoring intervals are also 1 second.

Designated 55 is an optical axis lamp driving circuit disposed in the light emitter 42. The optical axis lamp driving circuit 55 is activated by the light emission control signal from the light emission control/detector circuit 51 and an open-state signal (off signal) from a cover status sensor switch 70 that senses the status of the cover of the light emitter 42. The optical axis lamp driving circuit 55 drives an optical axis LED lamp 56 to flash it.

The range selection switch 37 disposed in the light receiver 1 gives to the control block 50 the reference signal representing the sensitivity determined by the monitoring range set.

When the cover status sensor switch 36 in the light receiver 1 detects the opening of the cover 2, it gives an open-state signal (off signal) to the control block 50 and an oscillator circuit 59 via a cover status input circuit 58. When it detects the closing of the cover 2, the cover status sensor switch 36 gives a closed-state signal (on signal) to the control block 50 and the oscillator circuit 59.

The oscillator circuit 59 oscillates when it receives both the open-state signal from the cover status sensor switch 36 and a 5 V regulated input which a 5 V voltage regulator circuit 60 gives at the input of the constant regulated voltage by the voltage regulating/current limiting circuit 47. The oscillation output of the oscillator circuit 59 is sent to an optical axis lamp control circuit 61.

When the control block 50 detects a fire during monitoring (for example, a light input drop ratio of 70% continues for a predetermined duration), the control block 50 outputs its signal to the fire signal output circuit 71, which in turn gives the fire signal to the control panel 46. Under this condition, if an irregularity is detected (for example, a light input drop ratio of 90% continues for a predetermined duration), the control block 50 prevents the irregularity signal from being output by blocking the irregularity signal from overriding the fire signal.

In response to the output from the fire signal output circuit 71, an irregularity signal output interrupting circuit 62 cuts off the irregularity signal from the control block 50. This action may be redundant, because the control block 50 is designed to prevent the irregularity signal during fire signal. Should the irregularity signal be given during fire signal, it will not be sent to the control panel 46.

When the control block 50 detects an irregularity due to blocking (for example, a light input drop ratio of 90% continues for a predetermined duration), the control block 50 sends its output to an irregularity signal output circuit 63 which in turn sends the irregularity signal to the control panel 46.

When an irregularity due to blocking of light path or when normal monitoring operation is interrupted, the control block 50 outputs the irregularity signal. In response to the irregularity signal, the irregularity lamp 35 flashes to indicate the occurrence of the irregularity. The irregularity signal output circuit 63 sends the irregularity signal over the irregularity signal line 45 to the control panel 46.

When detecting the fire signal from the control block 50, the fire signal output circuit 71 causes the fire alarm lamp 34 to flash via a diode 64. The fire signal output circuit 71 also sends the fire signal to the control panel 46 over the fire signal line 43.

Designated 54 is a light pickup element, made of a photodiode, disposed in the light receiver 1. Receiving near-infrared light that is generated in pulse by a light emitting element 53, the light pickup element 54 produces a light input signal proportional to input light intensity. The light input signal is converted by a photoelectric converter circuit 65 into electrical signal, which is then amplified by an amplifier 66. The photoelectric converter circuit 65 is made up of the light pickup element 54 and a potentiometer 72. By turning the light input level controls 28, 29 to vary the resistance of the potentiometer 72, a photoelectric conversion voltage is varied to control the light input level. The analog electrical signal amplified by the amplifier circuit 66 is processed by a peak-hold circuit 73, and sent to the control block 50 via a light input level input circuit 74. The control block 50 is constructed of an integrated circuit and contains an A/D converter 68. The analog signal is converted into a digital signal by the A/D converter 68.

The control block 50 stores a table 69 for driving LEDs 38A through 38F as monitor display means. Referring to its table 69, the control block 50 drives each of the LEDs 38A through 38F for flashing.

Figures 16, 17:
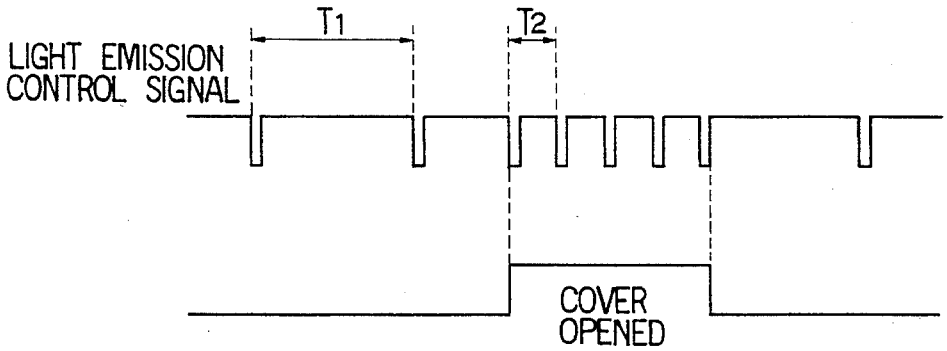
FIG. 16 is a table for the operation of LEDs.
FIG. 17 shows a light emission control signal.

FIG. 16 shows the driving table 69.

The resolution of the A/D converter 68 is 256, and thus its input analog signal is quantized into 256 levels. The full range of digital values, 0 to 255, is delineated into two insufficient light input level ranges, two appropriate light input level ranges and two excess light input level ranges.

In FIG. 16, the LED 38C of the two green LEDs indicative of appropriate level ranges covers a digital value range of 170 through 175 and its corresponding detected voltage range of 3.33 through 3.43 V. The other green LED 38D covers a digital value range of 176 through 180 and its corresponding detected voltage range of 3.45 through 3.52 V.

The LED 38A of the two yellow LEDs indicative insufficient light input level ranges covers a digital value range of 0 through 99 and its corresponding detected voltage range of 0.00 through 1.94 V. The other yellow LED 38B covers a digital value range of 100 through 169 and its corresponding detected voltage range of 1.96 through 3.31 V.

The LED 38E of the two red LEDs indicative of excess light input level ranges covers a digital value range of 181 through 199 and its corresponding detected voltage range of 3.54 through 3.90 V. The other red LED 38F covers a digital value range of 200 through 255 and its corresponding detected voltage range of 3.92 through 5.00 V.

The two green LEDs 38C and 38D have ranges narrower than those for the other four LEDs, 38A, 38B, 38E, and 38F. The full digital value range is delineated with the two green LEDs 38C and 38D centered therein, and as it deviates from the center, each delineated range becomes wider. The leftmost yellow LED 38A has a digital value range wider than that for the second leftmost yellow LED 38B. The rightmost red LED 38F has a digital value range wider than that for the second rightmost red LED 38E.

The control block 50 has as sensitivity setting status sensing means a sensitivity setting status sensing section 75 which determines the setting of the range selection DIL switch 37 that sets sensitivity corresponding to the monitoring range.

The control block 50 has a cover status sensing section 76 that determines whether the cover 2 is opened or closed, based on the on/off state of the cover sensor status switch 36. When the cover sensor status switch 36 is off, the cover status sensing section 76 determines that the cover 2 is opened. When the cover sensor status switch 36 is on, the cover sensing section 76 determines that the cover 2 is closed.

Furthermore, the control block 50 has as irregularity signal output means an irregularity signal output section 77 that gives the irregularity signal when any of the following conditions is detected.

(1) The cover 2 is closed with no sensitivity setting completed (sensitivity setting is forgotten).

(2) The cover is continuously opened for a predetermined time T1 and over (5 minutes and over, for example) even with sensitivity setting normally completed (the closing of the cover 2 is forgotten with sensitivity setting completed or any shock inadvertently applied forces a once closed cover 2 open).

(3) The cover is continuously opened for a predetermined time T2 and over (2 hours and over, for example) with no sensitivity setting completed (either the closing of the cover 2 or sensitivity setting is forgotten, though optical axis adjustment is performed, or no adjustment at all is performed after power on).

The irregularity signal is sent to the control panel 46 via the irregularity signal output interrupting circuit 62 and the irregularity signal output circuit 64 and also flashes the irregularity lamp 35.

The control block 50 has also an initial value setting section 78 as initial value setting means. When the sensitivity setting status sensing section 75 determines that sensitivity is set by the range selection switch 37 and when the cover status sensing section 76 determines the status of the cover 2 by the cover sensor status switch 36, the initial value setting section 78 sets the current light input level as an initial value when no initial value has yet been set.

Specifically, at power up, the initial value setting section 78 stores the current light input level as the initial value when no initial value is stored in or lost from RAM 81 with power recovered after a power interruption. The initial value setting section 78 newly stores the current light input level as the initial value when sensitivity is changed by the range selection switch 37.

The setting of the initial value is performed by storing a plurality of light inputs, for example, 5 light inputs (a light emission and pickup cycle repeated every 3 seconds), averaging them, and setting the averaged input level as the initial input. If a single input is adopted as the initial value, an erratic light input (like noise) can be set.

An initial value, even if averaged, may fall outside a predetermined range. If an initial value falls outside the predetermined range, an irregularity signal is output to set an initial value asensitivity.

The control block 50 has also a fire determination level processing section 79 as fire determination level processing means. The fire determination level processing section 79 calculates the fire determination level based on the stored initial value and the sensitivity set by the range selection switch 37.

Furthermore, the control block 50 has as fire monitoring means a fire monitoring section 80, which monitors for fire according to the fire determination level when the initial value has already been set.

Furthermore, the control block 50 has, as memory means, RAM 81 onto which the initial value and the fire determination level are stored. The stored initial value and fire determination level may be lost in the event of power interruption. When power is recovered, an initial value is set asensitivity and a fire determination level is calculated asensitivity when a memory loss is identified.

The control block 50 compares light input level with the fire determination level. When the current light input level is over the fire determination level smaller than the fire determination level or the reference signal, the control block 50 determines that a fire has broken out and outputs the fire signal to the fire signal output circuit 71.

The control block 50 is also provided with a monitoring interval changing section 84 as monitoring interval changing setting means. In response to the open-state signal from the cover status sensor switch 36 as the cover status sensor means, the monitoring interval changing section 84 changes the monitoring interval (flashing interval) to a short one. In response to the closed-state signal, the monitoring interval changing section 84 outputs to the light emission control circuit 48 as the light emission control means a signal for changing the monitoring interval to the normal one.

Specifically, the monitoring interval changing section 84 provides a 3-second interval signal to the light emission control circuit 48 in normal monitoring operation. In response to the open-state signal from the cover status sensor switch 36, the monitoring interval changing section 84 provides a 1-second interval signal to the light emission control circuit 48. The monitoring interval is then changed to 3 seconds when another closed-state signal is provided.

As shown in FIG. 16, the light emission control circuit 48 thus gives to the light emitter 42 the light emission control signal produced by interrupting the supplied voltage at intervals of T1 as long as 3 seconds in normal operation. When the cover 2 is opened during adjustment, the light emission control circuit 48 gives to the light emitter 42 the light emission control signal produced by interrupting the supplied voltage at intervals T2 as long as 1 second. Further, when the cover 2 is closed, the light emission control circuit 48 gives to the light emitter unit 42 the light emission control signal produced by interrupting the supplied voltage at intervals T2 as long as 1 second.

The monitoring interval is shortened while the cover 2 is opened. Therefore, no time delay results before any change is reflected in the signals in the course of adjustment.

Furthermore, the control block 50 contains a signal output disabling section 82 as signal output disabling means. In response to the open-state signal from the cover status sensor switch 36 as the cover status sensor means, the signal output disabling section 82 automatically sets the adjustment mode and prevents the fire signal and the irregularity signal from being output to the control panel 46. Specifically, during adjustment to optical axis and light input level, first, the output of the fire signal and the irregularity signal is disabled to allow the optical axis and light input level adjustments. Next, in response to the closed-state signal from the cover status sensor switch 36, the signal output disabling section 82 releases the disabling of the output of the fire signal and the irregularity signal.

Receiving the open-state signal from the cover status sensor switch 36 via the cover status input circuit 58, the optical axis lamp control circuit 61 causes the optical axis lamp 33 as the optical axis indicator means to flash driven by the oscillation output from the oscillator circuit 59. The flashing of the optical axis lamp 33 helps the technician easily observe from the light emitter side in optical axis adjustment.

In the same manner as above, the light emitter 42 causes the optical axis lamp driving circuit 55 to flash the optical axis lamp 56 in response to the open-state signal from the cover status sensor switch 70.

The optical axis lamp control circuit 61 and the optical axis lamp driving circuit 55 constitute part of adjustment enabling means 85.

Furthermore, the control block 50 is provided with a monitor display control block 83 as monitor display control means. The monitor display control block 83 causes LEDs 38A through 38F as monitor display means in response to the open-state signal from the cover status sensor switch 36 via the cover status input circuit 58.

The LEDs 38A through 38F flash only on the optical axis adjustment, it enhances their visibility from opposite side. The monitor display control block 83 extinguishes the LEDs 38A through 38F in response to the closed-state signal from the cover status sensor switch 36.

The monitor display control block 83, the light emission control circuit 48, and the monitoring interval changing section 84 constitute part of the adjustment enabling means 85.

The fire monitor section 80 as the fire monitoring means monitors for fire in response to the closed-state signal from the cover status sensor switch 36 via the cover status input circuit 58 when the optical axis adjustment is performed perfectly.

The operation of the smoke detector according to the present invention is now discussed.

Figure 18:
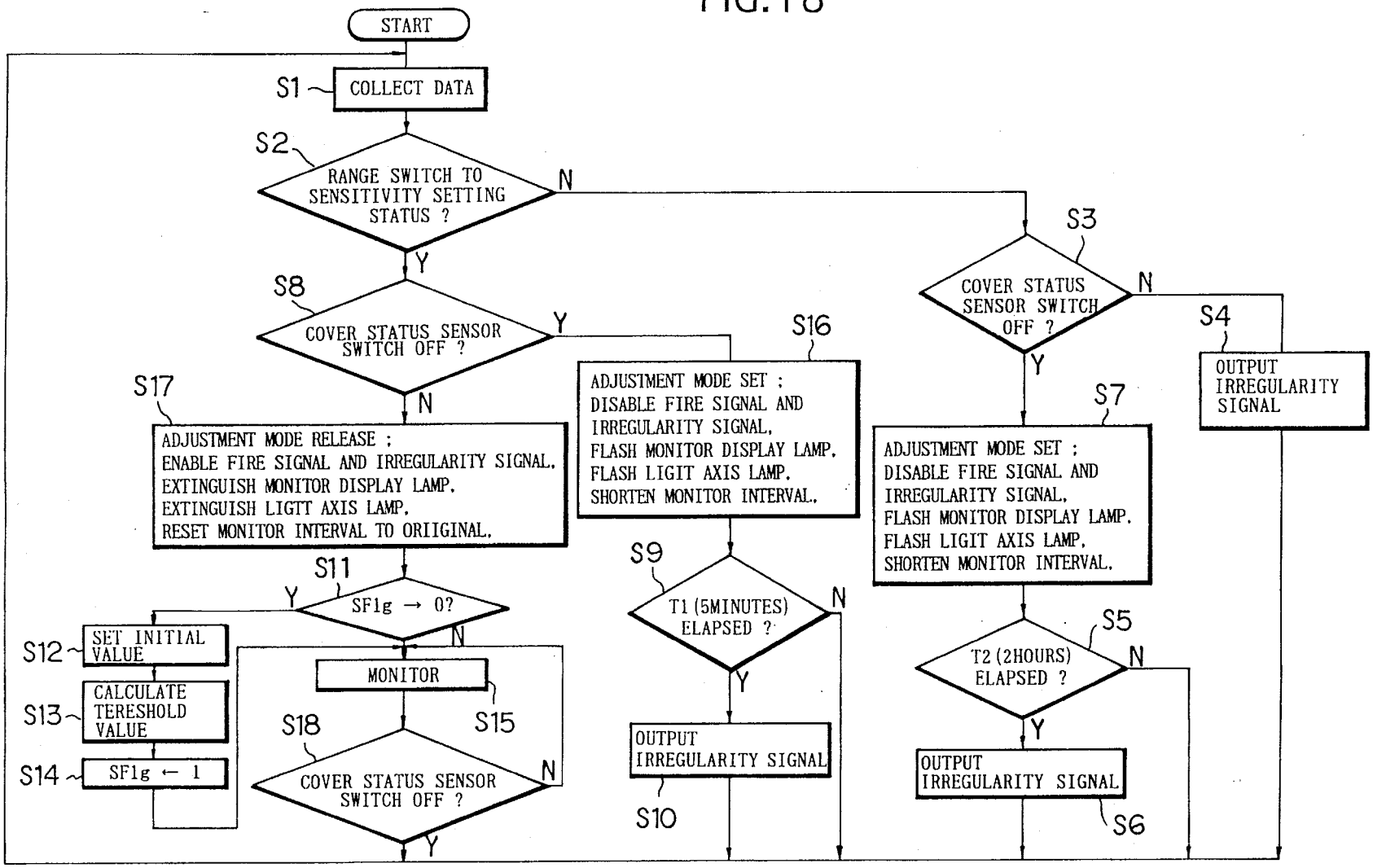
FIG. 18 is a flow diagram showing the operation of the smoke detector.
Figure 19:
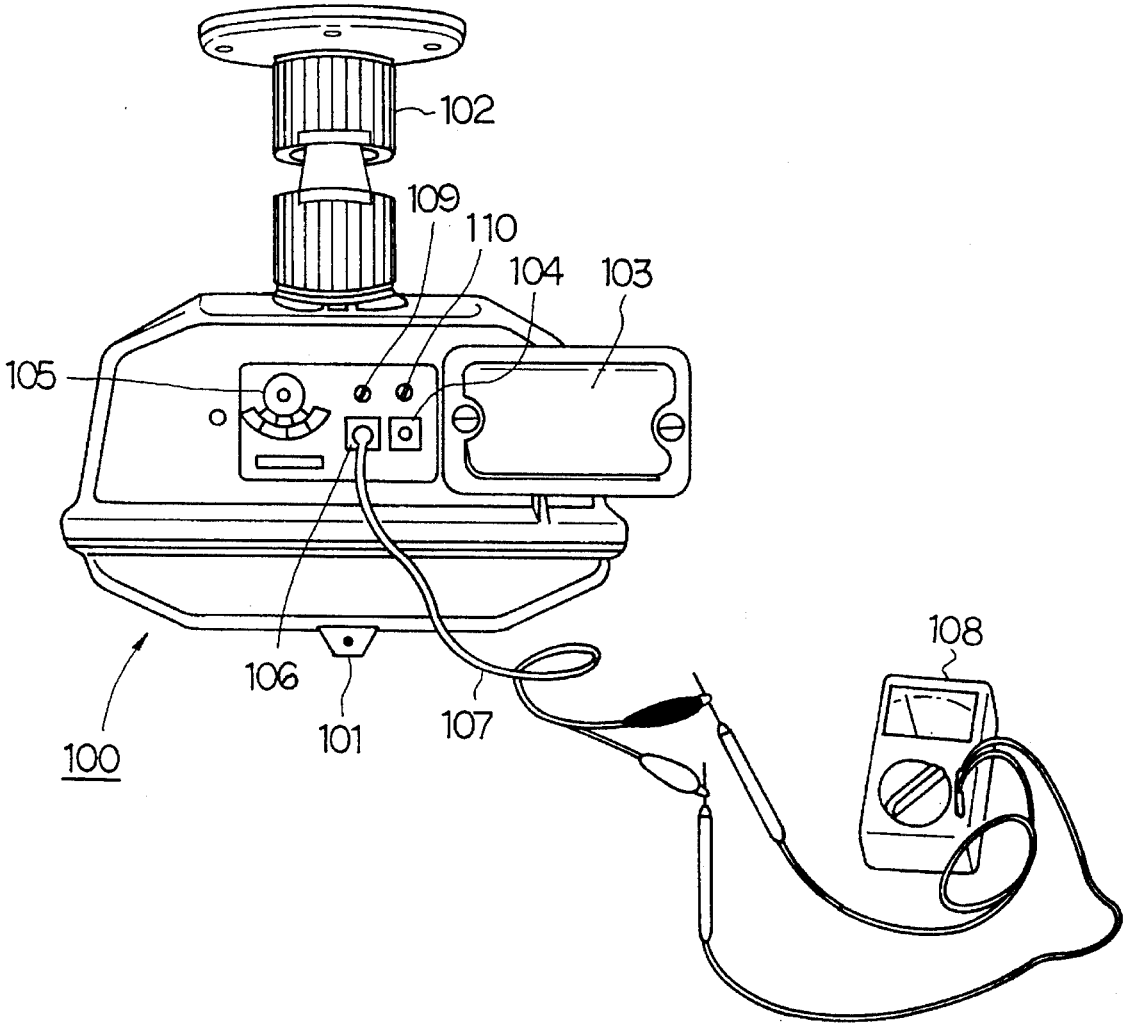
FIG. 19 shows the conventional smoke detector.
Figure 20:
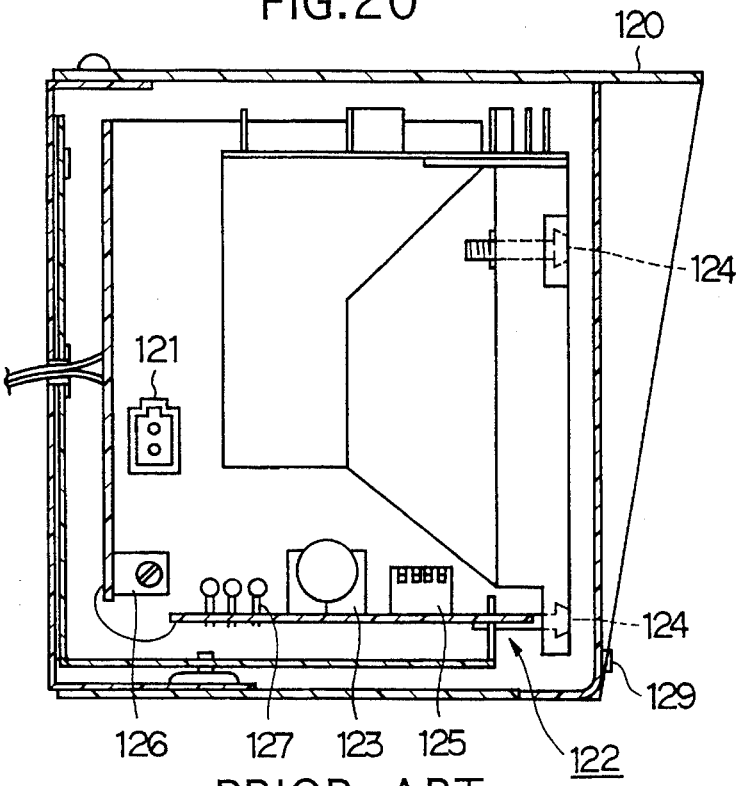
FIGS. 20 and 21 show another conventional smoke detector.
Figure 21:
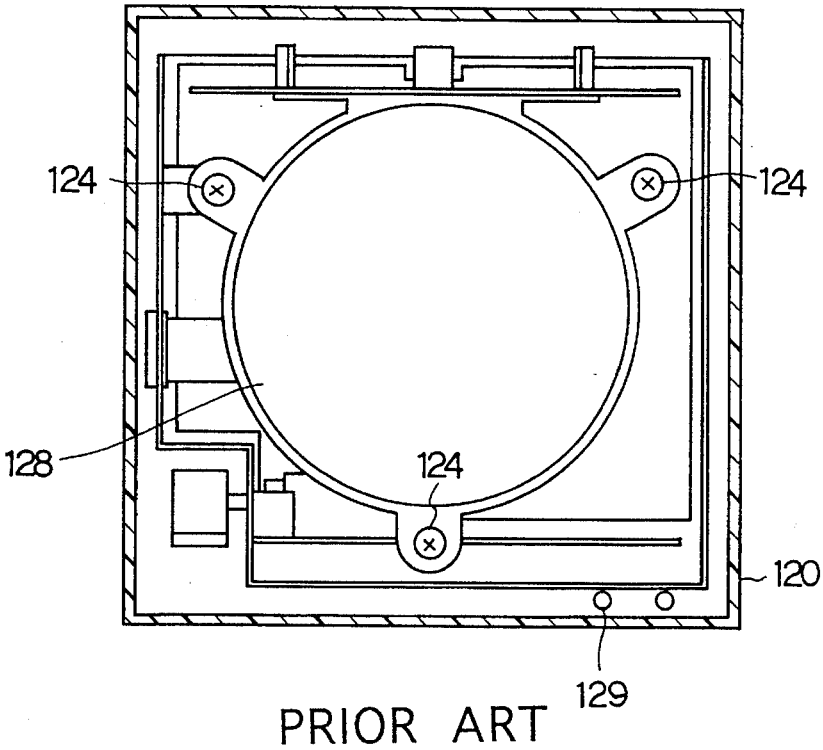
PRIOR ART FIG.21

FIG. 18 is the flow diagram showing the operation of the control block 50.

At step S1, data are collected. Specifically, the light pickup element 54 receives light, and light input signal which is processed through the photoelectric converter circuit 65, the amplifier circuit 66, the peak-hold circuit 73 and the light input level input circuit 74 is collected. The on signal (open-state signal) or off signal (closed-state signal) is collected from the cover status sensor switch 36 via the cover status input circuit 58. The DIL switch setting signal (sensitivity setting signal or no sensitivity setting signal) is collected from the range selection switch 37 via the sensitivity input circuit 57.

At step S2, a determination is made of whether or not the adjustment mode command switch is set for sensitivity setting. Since the adjustment mode command switch is constituted of the range selection switch 37, specifically, the determination is made of whether or not the range selection switch 37 is set for sensitivity setting. Specifically, the determination is made of an output from a sensitivity setting status sensing section 75. The processing of the chart goes to step S3, when sensitivity setting is not complete, or goes to step S8 when sensitivity setting is complete.

At step S3, a determination is made of whether the cover status sensor switch 36 is on. Specifically, the cover status sensing section 76 checks whether the cover 2 is opened. When the cover 2 is closed, the irregularity signal is immediately given at step S4 based on the determination that sensitivity setting is presumed forgotten. The irregularity signal output from the irregularity signal output section 77 is sent to the control panel 46 while it is fed to the irregularity lamp 35 to flash it. This alarms the operator of a forgotten sensitivity setting.

When the cover 2 is opened at step S3, the adjustment mode is set.

Specifically, the outputting of the fire signal and the irregularity signal are prevented. The signal output disabling section 82 disables the outputting of the fire signal to the fire signal output circuit 71 while preventing the irregularity signal output interrupting circuit 62 from giving the irregularity signal to the irregularity signal output circuit 63.

Further, LEDs 38A through 38F as the monitor display means are flashed, the optical axis lamp 33 as the optical axis indicator means is flashed, and the monitoring interval is shortened.

Specifically, the monitor display control block 83 causes LEDs 38A through LEDs 38F to flash in response to the open-state signal from the cover status sensor switch 36. The optical axis lamp control circuit 61 causes the optical axis lamp 33 to flash. The monitoring interval changing section 84 gives to the light emission control circuit 48 the signal produced by interrupting supply voltage at short intervals in order to shorten the monitoring interval.

Specifically, the monitoring interval changing section 84 changes the signal to the light emission control circuit 48 from intervals of 3 seconds to intervals of 1 second.

Receiving the signal having intervals of 1 second from the monitoring interval setting section 84, the light emission control circuit 48 produces the light emission control signal by interrupting the constant regulated voltage supplied from the voltage-regulating/current-limiting circuit 47 at intervals of 1 second and sends the light emission control signal to the light emitter 42.

In the light emitter 42, the light emission control/detection circuit 51 receives the light emission control signal from the light emission control circuit 48, and allows the light emission driving circuit 52 to operate at intervals of 1 second.

Driven by the light emission driving circuit 52, the light emitting element 53 emits near-infrared light toward the light pickup element 54 in the light receiver 1 at intervals of 1 second. The monitoring interval is thus shortened, practically no time delay takes place before the effect of adjustment such as optical axis adjustment is reflected in the signals. Adjustment at an elevated position is thus facilitated.

The adjustments of optical axis and light input level are performed under such an easy-to-adjust environment by disabling both the fire signal and the irregularity signal, by allowing the monitor display means and the optical axis indicator means to automatically flash, and by allowing the monitoring interval to automatically be shortened. The smoke detector is thus ready to be adjusted. Time required to perform each step of adjustment is shortened, and the chance of omission of a step is reduced. Thus, the adjustments of the smoke detector are performed in an easy and reliable manner.

When the adjustment mode is set at step S7, the processing of the chart goes to step S5. At step S5, a determination is made of whether or not a predetermined time T2, 2 hours for example, has elapsed at step S5. If it has, the irregularity signal is given at step S6. The predetermined time T2 may be determined considering the long time required to complete optical adjustment.

When a continuous two-hour long opening of the cover 2 with no sensitivity setting completed is detected, it is presumed that the closing of the cover 2 or sensitivity setting is forgotten though optical axis adjustment is performed or that no adjustment is performed at all though power is connected. In such a case, the irregularity signal output section 77 gives the irregularity signal to the control panel 46 while flashing the irregularity lamp 35. The irregularity signal thus alarms a person in charge of the occurrence of one of the above errors.

The adjustment of light input level is now briefly discussed.

The light input level control 28 for coarse adjustment is turned until one of the green LEDs 38C and 38D flashes. If red LEDs 38E or 38F flashes, turn the light input level control 28 in the direction of decrease until either LED 38C or LED 38D flashes. When one of the yellow LEDs 38A and 38B flashes, turn the light input level control 28 in the direction of increase until either LED 38C or LED 38D flashes.

When either LED 38C or LED 38D flashes, turn the light input level control 29 for fine adjustment to the center point of appropriate range where LED 38C and LED 38D border each other. The setting of the light input level is acceptable as long as either LED 38C or LED 38D flashes. Preferably, the control 29 is adjusted to the center point of the appropriate range where LED 38C and LED 38D flash alternately by alternately changing turning of the control 29 within a slight degree of rotation.

The use of two green LEDs 38C and 38D indicative of the appropriate value ranges help determine the center point of the appropriate ranges and appropriate ranges themselves. The light input level ranges of the green LEDs 38C and 38D are set to be narrow, thus the appropriate ranges are narrowed, and setting to the appropriate light input level is easy to make.

The use of two red LEDs 38E and 38F representing excess light input level and two yellow LEDs 38A and 38B representing insufficient light input level help distinguish between the range of excess light input level and the range of insufficient light input level.

When the sensitivity setting is complete at step S2, the processing goes to step S8. At step S8, a determination is made of whether the cover status sensor switch 36 is off or on. When the cover 2 is opened, the processing goes to step S16. At step S16, the adjustment mode is set, just like above mentioned, and the processing goes to step S9. At step S9, a determination is made of whether the predetermined time T1, 5 minutes, for example, has elapsed. When 5 minutes have elapsed, the irregularity signal is given at step S10. Namely, a continuous opening of the cover 2 with sensitivity setting completed is detected, the irregularity signal output section 77 gives the irregularity signal to the control panel 46 while flashing the irregularity lamp 35, based on the determination that the closing of the cover 2 is presumed forgotten with sensitivity setting completed or any shock inadvertently applied forces a once closed cover 2 open. A person in charge is thus alerted on the occurrence of the above errors. The predetermined time T1 is based on the short time normally required to complete a series of adjustment from sensitivity setting to closing the cover 2. In the predetermined time T1, the adjustment mode is set, and the adjustment can be done.

At step S8, a determination is made of whether the cover status sensor switch 36 is on or off. When the switch 36 is on, namely, the cover 2 is closed based on the determination that the adjustment has been completed, and the processing goes to step S17, the adjustment mode is closed.

Specifically, the signal output disabling section 82 release the disabling of the fire signal and the irregularity signal. The optical axis control circuit 61 extinguishes the optical axis lamp 33, and the monitor display control block 83 extinguishes the LEDs 38A through 38F.

Furthermore, the monitoring interval is reverted back to its original value. Specifically, the monitoring interval setting section 84 reverts the monitoring interval from 1 second to 3 seconds, and sends its signal in pulse to the light emission control circuit 48.

In response to the normal 3-second interval signal, the light emission control circuit 48 sends the emission control signal of the normal monitoring interval to the light emitter 42.

The disabling of the fire signal and the irregularity signal is automatically released, the driving of monitor display means and the optical axis indicator means are automatically stopped, and the monitoring interval is automatically reverted back to its normal value. As a result, the smoke detector is ready for fire monitoring operation. Time required to finish a series of adjustments is shortened, and the chance of omission of a step is reduced. Thus, the smoke detector is easily and quickly put back into active monitoring state.

After the adjustment mode is closed, the processing goes to step S11. At step S11, a determination is made of whether or not the flag indicative of the initial value setting is 0 (the initial value remains to be set). When the initial value has not yet been set, the processing goes to step S12 where the averaging a plurality of current light input value is entered as the initial value.

Specifically, the initial value setting section 78 automatically performs the initial value setting when it is set up for sensitivity setting at installation and, it automatically performs the initial value setting when the cover 2 is closed based on the determination that the optical axis adjustment and light input level adjustment have been completed. The initial value setting section 78 also automatically sets the light input level as the initial value when power is recovered in the event of a power interruption that caused the previously stored initial value to be lost. The initial value is computed by averaging a plurality of light input levels. The initial value should be fall within the predetermined range. If it falls outside the predetermined range, the irregularity signal is triggered and the computing of the initial value is repeated.

In succession to the initial value setting, the processing goes to step S13, where the fire determination level is computed based on the stored initial value and the sensitivity setting by the range selection switch 37.

The processing goes to step S14, where the flag is set to 1 to indicate that the initial value has been set, and the processing goes to step S15.

When step S11 reveals that the initial value has already been set, the processing goes to step S15 too. At step S15, the smoke detector continuously monitors at the fire determination level that has been computed at step S15. This monitoring action is continued until step S18 determines that the cover 2 is opened.

In this embodiment, the initial value is automatically set and the fire determination level is computed when it is found that the sensitivity setting is performed and that the cover 2 is closed. This eliminates such an inconvenience involving pressing a set button after closing a cover. Such a step often escapes attention of a technician. In the conventional smoke detector, the set button should be pressed asensitivity when power is recovered in the event of a power interruption that caused a stored initial value to be lost. Such an inconvenience is also eliminated in the smoke detector according to the present invention. Inactive fire monitoring time is thus shortened.

In the above embodiment, the current light Input level is stored as the initial value when no initial value has been set. In the same manner, it is contemplated that a fire determination level is computed along with the storing of the initial value.

What is claimed is:

1. A projected beam-type smoke detector of the type in which a light emitter having a light emitting element is separately mounted from a light receiver having a light pickup element in order to detect a fire by an attenuation in the level of light which the light receiver receives from the light emitter, said attenuation being due to the presence of smoke between the light emitter and the light receiver, comprising:

in the light receiver, cover status sensor means for sensing the closing or opening state of a cover that is closed or opened to allow at least optical axis adjustment, and a predetermined sensitivity setting for light input; and a control block for controlling each section of the light receiver, whereby the control block sets the adjustment mode to each section of the light receiver when the control block receives a cover open-state signal indicative of the opening of the cover from cover status sensor means.

2. The projected beam-type smoke detector according to claim 1, wherein said light receiver comprises an adjustment mode command switch for commanding setting an adjustment mode to each section of the light receiver when the adjustment is performed, whereby the control block sets the adjustment mode for a predetermined time T2 when the control block receives a cover open-state signal indicative of the opening of the cover from cover status sensor means and when the control block receives from the adjustment mode command switch an adjustment mode enabling signal indicative of the adjustment mode being commanded.

3. The projected beam-type smoke detector according to claim 2, wherein said light receiver comprises a sensitivity setting switch for setting sensitivity, said sensitivity setting switch constituting said adjustment mode command switch, whereby the sensitivity setting switch in its no sensitivity setting state is in the state that the adjustment mode is commanded from the adjustment mode command switch.

4. The projected beam-type smoke detector according to claim 3,

Wherein said light receiver comprise sensitivity setting status sensing means for determining the setting status of the sensitivity setting switch, Whereby the control block releases the adjustment mode from each section of the light receiver and sets the fire monitoring mode when the control block receives a cover closed-state signal indicative of the closing of the cover from the cover status sensor means and when the control block receives from the sensitivity setting status sensing means an sensitivity setting signal indicative of the setting of the sensitivity by the sensitivity setting switch.

5. The projected beam-type smoke detector according to claim 4, whereby the control block sets the adjustment mode for a predetermined time T1 when the control block receives a cover open-state signal indicative of the opening of the cover from cover statue sensor means and when the control block receives from the sensitivity setting status sensing means an sensitivity setting signal indicative of the setting of the sensitivity by the sensitivity setting switch.

6. The projected beam-type smoke detector according to any of claim 1, wherein said light receiver comprises signal output disabling means for disabling, under the adjustment mode, a fire signal that is provided when a fire is detected and an irregularity signal that is provided when irregularity occurred such as light emitted by the light emitter is blocked by any obstacle other than smoke and the like.

7. The projected beam-type smoke detector according to any of claim 1, wherein said light receiver comprises monitor display means that displays light input level to adjust input level of pulse light from the light emitter under the adjustment mode.

8. The projected beam-type smoke detector according to claim 7, wherein said monitor display means is made up of an LED that light or flashes when light input level is in appropriate range, another LED that light or flashes when light input level is in excessive range, and a third LED that light or flashes when light input level is in insufficient range, whereby the LED that light or flashes when light input level is in appropriate range is different from other LEDs in color and provided double.

9. The projected beam-type smoke detector according to claim 8, wherein said two LEDs that light or flashes when light input level is in appropriate range have ranges narrower than those for the other LEDs.

10. The projected beam-type smoke detector according to any of claim 1, wherein said light receiver comprises optical axis indicator means that flashes to help easily in optical axis adjustment.

11. The projected beam-type smoke detector according to any of claim 1, wherein said light receiver comprises light emission control means that gives to the light emitter a light emission control signal that controls the flashing interval of pulse light in light emitter, and monitoring interval changing means which gives to light emission control means a signal for changing the flashing interval to a shorter length than length of flashing interval for normal monitoring under the adjustment mode and which gives to light emission control means a signal for changing the flashing interval to normal length when the adjustment mode is released.

12. The projected beam-type smoke detector according to any of claim 1, wherein said light receiver comprises irregularity signal output means that gives the irregularity signal in response to the signals from cover status sensor means and sensitivity setting status sensing means, when a closing of the cover with no sensitivity setting completed is detected, when a continuous opening of the cover for T1 or longer time with sensitivity setting completed is detected, or when an opening of the cover for T2 or longer time with no sensitivity setting completed is detected.

13. The projected beam-type smoke detector according to any of claim 1, wherein said light receiver comprises initial value setting means which sets a light input level as an initial value that is used as a reference for computing a fire determination level that determines that a fire is breaking out when the closing of the cover with sensitivity setting completed is detected in response to the signals from cover status sensor means and sensitivity setting status sensing means, fire determination level computing means for computing the fire determination level based on the initial value stored by the initial value setting means and the sensitivity set by the sensitivity setting switch, and fire monitoring means for fire monitoring with respect to the fire determination level already computed when the initial value is already set.

14. The projected beam-type smoke detector according to claim 13, wherein said initial value setting means stores a plurality of light inputs of pulse light from the light emitter, averages them, and uses the averaged value as the initial value.

15. The projected beam-type smoke detector according to claim 13, wherein said initial value setting means output a irregularity signal when said initial value falls outside the predetermined range.

* * * * *